US006323880B1

(12) United States Patent
Yamada

(10) Patent No.: US 6,323,880 B1
(45) **Date of Patent: *Nov. 27, 2001**

(54) GRAY SCALE EXPRESSION METHOD AND GRAY SCALE DISPLAY DEVICE

(75) Inventor: Hachiro Yamada, Tokyo (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/936,801

(22) Filed: Sep. 24, 1997

(30) Foreign Application Priority Data

Sep. 25, 1996 (JP) ..... 8-253158
Mar. 4, 1997 (JP) ..... 9-049380

(51) Int. Cl.[7] ..... G09G 5/10; G09G 3/28
(52) U.S. Cl. ..... 345/690; 345/63; 345/60
(58) Field of Search ..... 345/60, 63, 89, 345/147–149, 690

(56) References Cited

U.S. PATENT DOCUMENTS

| | | | | |
|---|---|---|---|---|
| 5,313,224 | * | 5/1994 | Singhal et al. | 345/89 |
| 5,638,091 | | 6/1997 | Sarrasin | 345/147 |
| 5,757,343 | * | 5/1998 | Nagakubo et al. | 345/63 |
| 5,805,126 | * | 9/1998 | Bassetti | 345/149 |
| 5,818,419 | * | 10/1998 | Tajima et al. | 345/147 |
| 6,100,939 | | 8/2000 | Kougami | 348/687 |
| 6,144,364 | | 11/2000 | Otobe et al. . | |

FOREIGN PATENT DOCUMENTS

| | | |
|---|---|---|
| 0 653 740 | 5/1995 | (EP) . |
| 0 698 874 | 2/1996 | (EP) . |
| 3-145691 | 6/1991 | (JP) . |
| H5-127636 | 5/1993 | (JP) . |
| H6-259034 | 9/1994 | (JP) . |
| H6-318051 | 11/1994 | (JP) . |
| 7-7702 | 1/1995 | (JP) . |

(List continued on next page.)

OTHER PUBLICATIONS

Nakamura et al., "Invited Paper: Drive for 40–in.–Diagonal Full–Color ac Plasma Display", Society for Information Display International Symposium Digest of Technical Papers, vol. XXVI, 807–810 (1995).
Takikawa, "TV Display on an AC Plasma Panel", The Journal of Electronics and Communications Association of Japan, vol. J60–A, No. 1, 56–62 (1977).
Toda et al., "A Modified–Binary–Coded Light Emission Scheme for Suppressing Gray Scale Disturbances of Moving Images", Asia Display '95, 947–948 (1995).
Kohgami et al., "Gray–Scale Expression of TV Display Images on Gas Discharge Memory Panel Display", Technical Report of Electronic Information Communications Association of Japan, EID–90–9, 7–15 (1990).
"XP 002048673" *Abstract* (Jun. 21, 1996).

*Primary Examiner*—Richard Hjerpe
*Assistant Examiner*—Duc Q. Dinh
(74) *Attorney, Agent, or Firm*—Foley & Lardner

(57) ABSTRACT

In order to restrict a degradation of image quality due to fake contours of moving images, gray scale is displayed by dividing one field period into sub-fields and combining the sub-fields including a plurality of sub-fields weighted such that a light intensity of a certain one of the plurality of the sub-fields is smaller than two times a light intensity of a lower sub-field adjacent to the certain sub-field and larger than the light intensity of the lower sub-field. Further, a light intensity information code converter circuit responsive to binary numbers expressing weights of light intensities of the plurality of the sub-fields for outputting a light intensity information expressing weights in a range satisfying a condition that a light intensity of a certain one of the plurality of the sub-fields is smaller than two times a light intensity of a lower sub-field adjacent to the certain sub-field and larger than the light intensity of the lower sub-field.

6 Claims, 17 Drawing Sheets

FOREIGN PATENT DOCUMENTS

| | | |
|---|---|---|
| H7-175439 | 7/1995 | (JP) . |
| H7-507158 | 8/1995 | (JP) . |
| H9-34399 | 8/1995 | (JP) . |
| 7-271325 | 10/1995 | (JP) . |
| H7-281633 | 10/1995 | (JP) . |
| H8-160914 | 6/1996 | (JP) . |
| H7-168159 | 7/1996 | (JP) . |
| H8-179724 | 7/1996 | (JP) . |
| H8-149339 | 2/1997 | (JP) . |
| H9-83911 | 3/1997 | (JP) . |
| H9-230822 | 9/1997 | (JP) . |
| H9-311662 | 12/1997 | (JP) . |

* cited by examiner

FIG.1

| | GROUP 1 | | | | | GROUP 2 | | | | | GROUP 3 | | | | |
|---|---|---|---|---|---|---|---|---|---|---|---|---|---|---|---|
| SUB-FIELD NO. | SF 5 | SF 6 | SF 7 | SF 8 | SF 9 | SF 5 | SF 6 | SF 7 | SF 8 | SF 9 | SF 5 | SF 6 | SF 7 | SF 8 | SF 9 |
| BIT NO. | B4 | B5 | B6 | B7 | B8 | B4 | B5 | B6 | B7 | B8 | B4 | B5 | B6 | B7 | B8 |
| LIGHT INTENSITY | 16 | 32 | 48 | 64 | 80 | 16 | 32 | 48 | 64 | 80 | 16 | 32 | 48 | 64 | 80 |
| 0 ~ 15 | 0 | 0 | 0 | 0 | 0 | | | | | | | | | | |
| 16 ~ 31 | 1 | 0 | 0 | 0 | 0 | | | | | | | | | | |
| 32 ~ 47 | 0 | 1 | 0 | 0 | 0 | | | | | | | | | | |
| 48 ~ 63 | 1 | 1 | 0 | 0 | 0 | 0 | 0 | 1 | 0 | 0 | | | | | |
| 64 ~ 79 | 1 | 0 | 1 | 0 | 0 | 0 | 0 | 0 | 1 | 0 | | | | | |
| 80 ~ 95 | 0 | 1 | 1 | 0 | 0 | 1 | 0 | 0 | 1 | 0 | 0 | 0 | 0 | 0 | 1 |
| 96 ~ 111 | 1 | 1 | 1 | 0 | 0 | 0 | 1 | 0 | 1 | 0 | 1 | 0 | 0 | 0 | 1 |
| 112 ~ 127 | 1 | 1 | 0 | 1 | 0 | 0 | 0 | 1 | 1 | 0 | 0 | 1 | 0 | 0 | 1 |
| 128 ~ 143 | 1 | 0 | 1 | 1 | 0 | 1 | 1 | 0 | 0 | 1 | 0 | 0 | 1 | 0 | 1 |
| 144 ~ 159 | 0 | 1 | 1 | 1 | 0 | 1 | 0 | 1 | 0 | 1 | 0 | 0 | 0 | 1 | 1 |
| 160 ~ 175 | 1 | 1 | 1 | 1 | 0 | 0 | 1 | 1 | 0 | 1 | 1 | 0 | 0 | 1 | 1 |
| 176 ~ 191 | 1 | 1 | 1 | 0 | 1 | 0 | 1 | 0 | 1 | 1 | | | | | |
| 192 ~ 207 | 1 | 1 | 0 | 1 | 1 | 0 | 0 | 1 | 1 | 1 | | | | | |
| 208 ~ 223 | 1 | 0 | 1 | 1 | 1 | | | | | | | | | | |
| 224 ~ 239 | 0 | 1 | 1 | 1 | 1 | | | | | | | | | | |
| 240 ~ 255 | 1 | 1 | 1 | 1 | 1 | | | | | | | | | | |

FIG.3

| | GROUP 1 | | | | GROUP 2 | | | |
|---|---|---|---|---|---|---|---|---|
| SUB-FIELD NO. | SF 5 | SF 6 | SF 7 | SF 8 | SF 5 | SF 6 | SF 7 | SF 8 |
| BIT NO. | B4 | B5 | B6 | B7 | B4 | B5 | B6 | B7 |
| LIGHT INTENSITY | 16 | 32 | 48 | 64 | 16 | 32 | 48 | 64 |
| 0 ~ 15 | 0 | 0 | 0 | 0 | | | | |
| 16 ~ 31 | 1 | 0 | 0 | 0 | | | | |
| 32 ~ 47 | 0 | 1 | 0 | 0 | | | | |
| 48 ~ 63 | 1 | 1 | 0 | 0 | 0 | 0 | 1 | 0 |
| 64 ~ 79 | 1 | 0 | 1 | 0 | 0 | 0 | 0 | 1 |
| 80 ~ 95 | 0 | 1 | 1 | 0 | 1 | 0 | 0 | 1 |
| 96 ~ 111 | 1 | 1 | 1 | 0 | 0 | 1 | 0 | 1 |
| 112 ~ 127 | 1 | 1 | 0 | 1 | 0 | 0 | 1 | 1 |
| 128 ~ 143 | 1 | 0 | 1 | 1 | | | | |
| 144 ~ 159 | 0 | 1 | 1 | 1 | | | | |
| 160 ~ 175 | 1 | 1 | 1 | 1 | | | | |

FIG.4

| | GROUP 1 | | | | | GROUP 2 | | | | |
|---|---|---|---|---|---|---|---|---|---|---|
| SUB-FIELD NO. | SF 1 | SF 2 | SF 3 | SF 4 | SF 5 | SF 1 | SF 2 | SF 3 | SF 4 | SF 5 |
| BIT NO. | B0 | B1 | B2 | B3 | B4 | B0 | B1 | B2 | B3 | B4 |
| LIGHT INTENSITY | 1 | 2 | 3 | 7 | 8 | 1 | 2 | 3 | 7 | 8 |
| 0 | 0 | 0 | 0 | 0 | 0 | | | | | |
| 1 | 1 | 0 | 0 | 0 | 0 | | | | | |
| 2 | 0 | 1 | 0 | 0 | 0 | | | | | |
| 3 | 1 | 1 | 0 | 0 | 0 | | | | | |
| 4 | 1 | 0 | 1 | 0 | 0 | | | | | |
| 5 | 0 | 1 | 1 | 0 | 0 | | | | | |
| 6 | 1 | 1 | 1 | 0 | 0 | | | | | |
| 7 | 0 | 0 | 0 | 1 | 0 | | | | | |
| 8 | 0 | 0 | 0 | 0 | 1 | 1 | 0 | 0 | 1 | 0 |
| 9 | 1 | 0 | 0 | 0 | 1 | 0 | 1 | 0 | 1 | 0 |
| 10 | 0 | 1 | 0 | 0 | 1 | 1 | 1 | 0 | 1 | 0 |
| 11 | 1 | 1 | 0 | 0 | 1 | 1 | 0 | 1 | 1 | 0 |
| 12 | 1 | 0 | 1 | 0 | 1 | 0 | 1 | 1 | 1 | 0 |
| 13 | 0 | 1 | 1 | 0 | 1 | 1 | 1 | 1 | 1 | 0 |
| 14 | 1 | 1 | 1 | 0 | 1 | | | | | |
| 15 | 0 | 0 | 0 | 1 | 1 | | | | | |

FIG.5

| | GROUP 1 | | | | | GROUP 2 | | | | |
|---|---|---|---|---|---|---|---|---|---|---|
| SUB-FIELD NO. | SF 1 | SF 2 | SF 3 | SF 4 | SF 5 | SF 1 | SF 2 | SF 3 | SF 4 | SF 5 |
| BIT NO. | B0 | B1 | B2 | B3 | B4 | B0 | B1 | B2 | B3 | B4 |
| LIGHT INTENSITY | 1 | 2 | 3 | 6 | 8 | 1 | 2 | 3 | 6 | 8 |
| 0 | 0 | 0 | 0 | 0 | 0 | | | | | |
| 1 | 1 | 0 | 0 | 0 | 0 | | | | | |
| 2 | 0 | 1 | 0 | 0 | 0 | | | | | |
| 3 | 1 | 1 | 0 | 0 | 0 | | | | | |
| 4 | 0 | 0 | 1 | 0 | 0 | | | | | |
| 5 | 1 | 0 | 1 | 0 | 0 | | | | | |
| 6 | 0 | 0 | 0 | 1 | 0 | 0 | 1 | 1 | 0 | 0 |
| 7 | 1 | 0 | 0 | 1 | 0 | 1 | 1 | 1 | 0 | 0 |
| 8 | 0 | 0 | 0 | 0 | 1 | 0 | 1 | 0 | 1 | 0 |
| 9 | 1 | 0 | 0 | 0 | 1 | 1 | 1 | 0 | 1 | 0 |
| 10 | 0 | 1 | 0 | 0 | 1 | 0 | 0 | 1 | 1 | 0 |
| 11 | 1 | 1 | 0 | 0 | 1 | 1 | 0 | 1 | 1 | 0 |
| 12 | 0 | 0 | 1 | 0 | 1 | 0 | 1 | 1 | 1 | 0 |
| 13 | 1 | 0 | 1 | 0 | 1 | 1 | 1 | 1 | 1 | 0 |
| 14 | 0 | 0 | 0 | 1 | 1 | 0 | 1 | 1 | 0 | 1 |
| 15 | 1 | 0 | 0 | 1 | 1 | 1 | 1 | 1 | 0 | 1 |

FIG.6

| SUB-FIELD NO. | SF 1 | SF 2 | SF 3 | SF 4 | SF 5 | SF 6 | SF 7 | SF 8 | SF 9 |
|---|---|---|---|---|---|---|---|---|---|
| BIT NO. | B0 | B1 | B2 | B3 | B4 | B5 | B6 | B7 | B8 |
| LIGHT INTENSITY | 1 | 2 | 4 | 7 | 12 | 20 | 33 | 54 | 88 |
| 0 | 0 | 0 | 0 | 0 | 0 | 0 | 0 | 0 | 0 |
| 1 | 1 | 0 | 0 | 0 | 0 | 0 | 0 | 0 | 0 |
| 2 | 0 | 1 | 0 | 0 | 0 | 0 | 0 | 0 | 0 |
| 3 | 0 | 0 | 1 | 0 | 0 | 0 | 0 | 0 | 0 |
| 4 | 1 | 0 | 1 | 0 | 0 | 0 | 0 | 0 | 0 |
| 5 | 0 | 1 | 1 | 0 | 0 | 0 | 0 | 0 | 0 |
| 6 | 1 | 0 | 0 | 1 | 0 | 0 | 0 | 0 | 0 |
| 7 | 0 | 1 | 0 | 1 | 0 | 0 | 0 | 0 | 0 |
| 8 | 0 | 0 | 1 | 1 | 0 | 0 | 0 | 0 | 0 |
| 9 | 0 | 1 | 0 | 0 | 1 | 0 | 0 | 0 | 0 |
| 10 | 0 | 0 | 1 | 0 | 1 | 0 | 0 | 0 | 0 |
| 11 | 1 | 0 | 1 | 0 | 1 | 0 | 0 | 0 | 0 |
| 12 | 0 | 0 | 0 | 1 | 1 | 0 | 0 | 0 | 0 |
| 13 | 0 | 0 | 1 | 0 | 0 | 1 | 0 | 0 | 0 |
| 14 | 1 | 0 | 1 | 0 | 0 | 1 | 0 | 0 | 0 |
| 15 | 0 | 0 | 0 | 1 | 0 | 1 | 0 | 0 | 0 |
| 16 | 1 | 0 | 0 | 1 | 0 | 1 | 0 | 0 | 0 |
| 17 | 0 | 0 | 0 | 0 | 1 | 1 | 0 | 0 | 0 |
| 18 | 0 | 0 | 0 | 1 | 0 | 0 | 1 | 0 | 0 |
| 19 | 1 | 0 | 0 | 1 | 0 | 0 | 1 | 0 | 0 |
| 20 | 0 | 0 | 0 | 0 | 1 | 0 | 1 | 0 | 0 |
| 21 | 1 | 0 | 0 | 0 | 1 | 0 | 1 | 0 | 0 |
| 22 | 0 | 1 | 0 | 0 | 1 | 0 | 1 | 0 | 0 |
| 23 | 0 | 0 | 0 | 0 | 0 | 1 | 1 | 0 | 0 |
| 24 | 0 | 0 | 0 | 0 | 1 | 0 | 0 | 1 | 0 |
| 25 | 1 | 0 | 0 | 0 | 1 | 0 | 0 | 1 | 0 |
| 26 | 0 | 1 | 0 | 0 | 1 | 0 | 0 | 1 | 0 |
| 27 | 0 | 0 | 1 | 0 | 1 | 0 | 0 | 1 | 0 |
| 28 | 1 | 0 | 1 | 0 | 1 | 0 | 0 | 1 | 0 |
| 29 | 0 | 1 | 0 | 1 | 0 | 1 | 0 | 1 | 0 |
| 30 | 0 | 0 | 0 | 0 | 0 | 0 | 1 | 1 | 0 |
| 31 | 0 | 0 | 1 | 1 | 0 | 1 | 0 | 0 | 0 |
| 32 | 0 | 0 | 0 | 0 | 1 | 1 | 0 | 0 | 0 |
| 33 | 0 | 0 | 0 | 0 | 0 | 0 | 1 | 0 | 0 |
| 34 | 1 | 0 | 0 | 0 | 0 | 0 | 1 | 0 | 0 |
| 35 | 0 | 1 | 0 | 0 | 0 | 0 | 1 | 0 | 0 |
| 36 | 1 | 1 | 0 | 0 | 0 | 0 | 1 | 0 | 0 |
| 37 | 0 | 0 | 1 | 0 | 0 | 0 | 1 | 0 | 0 |
| 38 | 1 | 0 | 1 | 0 | 0 | 0 | 1 | 0 | 0 |
| 39 | 0 | 1 | 1 | 0 | 0 | 0 | 1 | 0 | 0 |
| 40 | 0 | 0 | 0 | 1 | 0 | 0 | 1 | 0 | 0 |
| 41 | 1 | 0 | 0 | 1 | 0 | 0 | 1 | 0 | 0 |
| 42 | 0 | 1 | 0 | 1 | 0 | 0 | 1 | 0 | 0 |
| 43 | 1 | 1 | 0 | 1 | 0 | 0 | 1 | 0 | 0 |
| 44 | 0 | 0 | 1 | 1 | 0 | 0 | 1 | 0 | 0 |
| 45 | 0 | 0 | 0 | 0 | 1 | 0 | 1 | 0 | 0 |
| 46 | 1 | 0 | 0 | 0 | 1 | 0 | 1 | 0 | 0 |
| 47 | 0 | 1 | 0 | 0 | 1 | 0 | 1 | 0 | 0 |
| 48 | 1 | 1 | 0 | 0 | 1 | 0 | 1 | 0 | 0 |
| 49 | 0 | 0 | 1 | 0 | 1 | 0 | 1 | 0 | 0 |
| 50 | 1 | 0 | 1 | 0 | 1 | 0 | 1 | 0 | 0 |
| 51 | 0 | 1 | 1 | 0 | 1 | 0 | 1 | 0 | 0 |
| 52 | 0 | 0 | 0 | 1 | 1 | 0 | 1 | 0 | 0 |

| SUB-FIELD NO. | SF 1 | SF 2 | SF 3 | SF 4 | SF 5 | SF 6 | SF 7 | SF 8 | SF 9 |
|---|---|---|---|---|---|---|---|---|---|
| BIT NO. | B0 | B1 | B2 | B3 | B4 | B5 | B6 | B7 | B8 |
| LIGHT INTENSITY | 1 | 2 | 4 | 7 | 12 | 20 | 33 | 54 | 88 |
| 111 | 1 | 1 | 0 | 0 | 0 | 1 | 0 | 0 | 1 |
| 112 | 0 | 0 | 1 | 0 | 0 | 1 | 0 | 0 | 1 |
| 113 | 1 | 0 | 1 | 0 | 0 | 1 | 0 | 0 | 1 |
| 114 | 0 | 1 | 1 | 0 | 0 | 1 | 0 | 0 | 1 |
| 115 | 0 | 0 | 0 | 1 | 0 | 1 | 0 | 0 | 1 |
| 116 | 1 | 0 | 0 | 1 | 0 | 1 | 0 | 0 | 1 |
| 117 | 0 | 1 | 0 | 1 | 0 | 1 | 0 | 0 | 1 |
| 118 | 1 | 1 | 0 | 1 | 0 | 1 | 0 | 0 | 1 |
| 119 | 0 | 0 | 1 | 1 | 0 | 1 | 0 | 0 | 1 |
| 120 | 0 | 0 | 0 | 0 | 1 | 1 | 0 | 0 | 1 |
| 121 | 0 | 0 | 0 | 0 | 0 | 0 | 1 | 0 | 1 |
| 122 | 1 | 0 | 0 | 0 | 0 | 0 | 1 | 0 | 1 |
| 123 | 0 | 1 | 0 | 0 | 0 | 0 | 1 | 0 | 1 |
| 124 | 1 | 1 | 0 | 0 | 0 | 0 | 1 | 0 | 1 |
| 125 | 0 | 0 | 1 | 0 | 0 | 0 | 1 | 0 | 1 |
| 126 | 1 | 0 | 1 | 0 | 0 | 0 | 1 | 0 | 1 |
| 127 | 0 | 1 | 1 | 0 | 0 | 0 | 1 | 0 | 1 |
| 128 | 0 | 0 | 0 | 1 | 0 | 0 | 1 | 0 | 1 |
| 129 | 1 | 0 | 0 | 1 | 0 | 0 | 1 | 0 | 1 |
| 130 | 0 | 1 | 0 | 1 | 0 | 0 | 1 | 0 | 1 |
| 131 | 1 | 1 | 0 | 1 | 0 | 0 | 1 | 0 | 1 |
| 132 | 0 | 0 | 1 | 1 | 0 | 0 | 1 | 0 | 1 |
| 133 | 0 | 0 | 0 | 0 | 1 | 0 | 1 | 0 | 1 |
| 134 | 1 | 0 | 0 | 0 | 1 | 0 | 1 | 0 | 1 |
| 135 | 0 | 1 | 0 | 0 | 1 | 0 | 1 | 0 | 1 |
| 136 | 1 | 1 | 0 | 0 | 1 | 0 | 1 | 0 | 1 |
| 137 | 0 | 0 | 1 | 0 | 1 | 0 | 1 | 0 | 1 |
| 138 | 1 | 0 | 1 | 0 | 1 | 0 | 1 | 0 | 1 |
| 139 | 0 | 1 | 1 | 0 | 1 | 0 | 1 | 0 | 1 |
| 140 | 0 | 0 | 0 | 1 | 1 | 0 | 1 | 0 | 1 |
| 141 | 0 | 0 | 0 | 0 | 0 | 1 | 1 | 0 | 1 |
| 142 | 0 | 0 | 0 | 0 | 0 | 0 | 0 | 1 | 1 |
| 143 | 1 | 0 | 0 | 0 | 0 | 0 | 0 | 1 | 1 |
| 144 | 0 | 1 | 0 | 0 | 0 | 0 | 0 | 1 | 1 |
| 145 | 1 | 1 | 0 | 0 | 0 | 0 | 0 | 1 | 1 |
| 146 | 0 | 0 | 1 | 0 | 0 | 0 | 0 | 1 | 1 |
| 147 | 1 | 0 | 1 | 0 | 0 | 0 | 0 | 1 | 1 |
| 148 | 0 | 1 | 1 | 0 | 0 | 0 | 0 | 1 | 1 |
| 149 | 0 | 0 | 0 | 1 | 0 | 0 | 0 | 1 | 1 |
| 150 | 1 | 0 | 0 | 1 | 0 | 0 | 0 | 1 | 1 |
| 151 | 0 | 1 | 0 | 1 | 0 | 0 | 0 | 1 | 1 |
| 152 | 1 | 1 | 0 | 1 | 0 | 0 | 0 | 1 | 1 |
| 153 | 0 | 0 | 1 | 1 | 0 | 0 | 0 | 1 | 1 |
| 154 | 0 | 0 | 0 | 0 | 1 | 0 | 0 | 1 | 1 |
| 155 | 1 | 0 | 0 | 0 | 1 | 0 | 0 | 1 | 1 |
| 156 | 0 | 1 | 0 | 0 | 1 | 0 | 0 | 1 | 1 |
| 157 | 1 | 1 | 0 | 0 | 1 | 0 | 0 | 1 | 1 |
| 158 | 0 | 0 | 1 | 0 | 1 | 0 | 0 | 1 | 1 |
| 159 | 1 | 0 | 1 | 0 | 1 | 0 | 0 | 1 | 1 |
| 160 | 0 | 1 | 1 | 0 | 1 | 0 | 0 | 1 | 1 |
| 161 | 0 | 0 | 0 | 1 | 1 | 0 | 0 | 1 | 1 |
| 162 | 0 | 0 | 0 | 0 | 0 | 1 | 0 | 1 | 1 |
| 163 | 1 | 0 | 0 | 0 | 0 | 1 | 0 | 1 | 1 |

FIG.7

| | | | | | | | | | |
|---|---|---|---|---|---|---|---|---|---|
| 53 | 0 | 0 | 0 | 0 | 0 | 1 | 1 | 0 | 0 |
| 54 | 0 | 0 | 0 | 0 | 0 | 0 | 0 | 1 | 0 |
| 55 | 1 | 0 | 0 | 0 | 0 | 0 | 0 | 1 | 0 |
| 56 | 0 | 1 | 0 | 0 | 0 | 0 | 0 | 1 | 0 |
| 57 | 1 | 1 | 0 | 0 | 0 | 0 | 0 | 1 | 0 |
| 58 | 0 | 0 | 1 | 0 | 0 | 0 | 0 | 1 | 0 |
| 59 | 1 | 0 | 1 | 0 | 0 | 0 | 0 | 1 | 0 |
| 60 | 0 | 1 | 1 | 0 | 0 | 0 | 0 | 1 | 0 |
| 61 | 0 | 0 | 0 | 1 | 0 | 0 | 0 | 1 | 0 |
| 62 | 1 | 0 | 0 | 1 | 0 | 0 | 0 | 1 | 0 |
| 63 | 0 | 1 | 0 | 1 | 0 | 0 | 0 | 1 | 0 |
| 64 | 1 | 1 | 0 | 1 | 0 | 0 | 0 | 1 | 0 |
| 65 | 0 | 0 | 1 | 1 | 0 | 0 | 0 | 1 | 0 |
| 66 | 0 | 0 | 0 | 0 | 1 | 0 | 0 | 1 | 0 |
| 67 | 1 | 0 | 0 | 0 | 1 | 0 | 0 | 1 | 0 |
| 68 | 0 | 1 | 0 | 0 | 1 | 0 | 0 | 1 | 0 |
| 69 | 1 | 1 | 0 | 0 | 1 | 0 | 0 | 1 | 0 |
| 70 | 0 | 0 | 1 | 0 | 1 | 0 | 0 | 1 | 0 |
| 71 | 1 | 0 | 1 | 0 | 1 | 0 | 0 | 1 | 0 |
| 72 | 0 | 1 | 1 | 0 | 1 | 0 | 0 | 1 | 0 |
| 73 | 0 | 0 | 0 | 1 | 1 | 0 | 0 | 1 | 0 |
| 74 | 0 | 0 | 0 | 0 | 0 | 1 | 0 | 1 | 0 |
| 75 | 1 | 0 | 0 | 0 | 0 | 1 | 0 | 1 | 0 |
| 76 | 0 | 1 | 0 | 0 | 0 | 1 | 0 | 1 | 0 |
| 77 | 1 | 1 | 0 | 0 | 0 | 1 | 0 | 1 | 0 |
| 78 | 0 | 0 | 1 | 0 | 0 | 1 | 0 | 1 | 0 |
| 79 | 1 | 0 | 1 | 0 | 0 | 1 | 0 | 1 | 0 |
| 80 | 0 | 1 | 1 | 0 | 0 | 1 | 0 | 1 | 0 |
| 81 | 0 | 0 | 0 | 1 | 0 | 1 | 0 | 1 | 0 |
| 82 | 1 | 0 | 0 | 1 | 0 | 1 | 0 | 1 | 0 |
| 83 | 0 | 1 | 0 | 1 | 0 | 1 | 0 | 1 | 0 |
| 84 | 1 | 1 | 0 | 1 | 0 | 1 | 0 | 1 | 0 |
| 85 | 0 | 0 | 1 | 1 | 0 | 1 | 0 | 1 | 0 |
| 86 | 0 | 0 | 0 | 0 | 1 | 1 | 0 | 1 | 0 |
| 87 | 0 | 0 | 0 | 0 | 0 | 0 | 1 | 1 | 0 |
| 88 | 0 | 0 | 0 | 0 | 0 | 0 | 0 | 0 | 1 |
| 89 | 1 | 0 | 0 | 0 | 0 | 0 | 0 | 0 | 1 |
| 90 | 0 | 1 | 0 | 0 | 0 | 0 | 0 | 0 | 1 |
| 91 | 1 | 1 | 0 | 0 | 0 | 0 | 0 | 0 | 1 |
| 92 | 0 | 0 | 1 | 0 | 0 | 0 | 0 | 0 | 1 |
| 93 | 1 | 0 | 1 | 0 | 0 | 0 | 0 | 0 | 1 |
| 94 | 0 | 1 | 1 | 0 | 0 | 0 | 0 | 0 | 1 |
| 95 | 0 | 0 | 0 | 1 | 0 | 0 | 0 | 0 | 1 |
| 96 | 1 | 0 | 0 | 1 | 0 | 0 | 0 | 0 | 1 |
| 97 | 0 | 1 | 0 | 1 | 0 | 0 | 0 | 0 | 1 |
| 98 | 1 | 1 | 0 | 1 | 0 | 0 | 0 | 0 | 1 |
| 99 | 0 | 0 | 1 | 1 | 0 | 0 | 0 | 0 | 1 |
| 100 | 0 | 0 | 0 | 0 | 1 | 0 | 0 | 0 | 1 |
| 101 | 1 | 0 | 0 | 0 | 1 | 0 | 0 | 0 | 1 |
| 102 | 0 | 1 | 0 | 0 | 1 | 0 | 0 | 0 | 1 |
| 103 | 1 | 1 | 0 | 0 | 1 | 0 | 0 | 0 | 1 |
| 104 | 0 | 0 | 1 | 0 | 1 | 0 | 0 | 0 | 1 |
| 105 | 1 | 0 | 1 | 0 | 1 | 0 | 0 | 0 | 1 |
| 106 | 0 | 1 | 1 | 0 | 1 | 0 | 0 | 0 | 1 |
| 107 | 0 | 0 | 0 | 1 | 1 | 0 | 0 | 0 | 1 |
| 108 | 0 | 0 | 0 | 0 | 0 | 1 | 0 | 0 | 1 |
| 109 | 1 | 0 | 0 | 0 | 0 | 1 | 0 | 0 | 1 |
| 110 | 0 | 1 | 0 | 0 | 0 | 1 | 0 | 0 | 1 |

| | | | | | | | | | |
|---|---|---|---|---|---|---|---|---|---|
| 164 | 0 | 1 | 0 | 0 | 0 | 1 | 0 | 1 | 1 |
| 165 | 1 | 1 | 0 | 0 | 0 | 1 | 0 | 1 | 1 |
| 166 | 0 | 0 | 1 | 0 | 0 | 1 | 0 | 1 | 1 |
| 167 | 1 | 0 | 1 | 0 | 0 | 1 | 0 | 1 | 1 |
| 168 | 0 | 1 | 1 | 0 | 0 | 1 | 0 | 1 | 1 |
| 169 | 0 | 0 | 0 | 1 | 0 | 1 | 0 | 1 | 1 |
| 170 | 1 | 0 | 0 | 1 | 0 | 1 | 0 | 1 | 1 |
| 171 | 0 | 1 | 0 | 1 | 0 | 1 | 0 | 1 | 1 |
| 172 | 1 | 1 | 0 | 1 | 0 | 1 | 0 | 1 | 1 |
| 173 | 0 | 0 | 1 | 1 | 0 | 1 | 0 | 1 | 1 |
| 174 | 0 | 0 | 0 | 0 | 1 | 1 | 0 | 1 | 1 |
| 175 | 0 | 0 | 0 | 0 | 0 | 0 | 1 | 1 | 1 |
| 176 | 1 | 0 | 0 | 0 | 0 | 0 | 1 | 1 | 1 |
| 177 | 0 | 1 | 0 | 0 | 0 | 0 | 1 | 1 | 1 |
| 178 | 1 | 1 | 0 | 0 | 0 | 0 | 1 | 1 | 1 |
| 179 | 0 | 0 | 1 | 1 | 0 | 0 | 1 | 1 | 1 |
| 180 | 1 | 0 | 1 | 1 | 0 | 0 | 1 | 1 | 1 |
| 181 | 0 | 1 | 1 | 1 | 0 | 0 | 1 | 1 | 1 |
| 182 | 0 | 0 | 0 | 0 | 0 | 0 | 1 | 1 | 1 |
| 183 | 1 | 0 | 0 | 0 | 0 | 0 | 1 | 1 | 1 |
| 184 | 0 | 1 | 0 | 0 | 0 | 0 | 1 | 1 | 1 |
| 185 | 1 | 1 | 0 | 0 | 0 | 0 | 1 | 1 | 1 |
| 186 | 0 | 0 | 1 | 1 | 0 | 0 | 1 | 1 | 1 |
| 187 | 0 | 0 | 0 | 0 | 1 | 1 | 1 | 1 | 1 |
| 188 | 1 | 0 | 0 | 0 | 1 | 1 | 1 | 1 | 1 |
| 189 | 0 | 1 | 0 | 0 | 1 | 1 | 1 | 1 | 1 |
| 190 | 1 | 1 | 0 | 0 | 1 | 1 | 1 | 1 | 1 |
| 191 | 0 | 0 | 1 | 1 | 1 | 1 | 1 | 1 | 1 |
| 192 | 1 | 0 | 1 | 1 | 1 | 1 | 1 | 1 | 1 |
| 193 | 0 | 1 | 1 | 1 | 1 | 1 | 1 | 1 | 1 |
| 194 | 0 | 0 | 0 | 0 | 1 | 1 | 1 | 1 | 1 |
| 195 | 0 | 0 | 0 | 0 | 0 | 0 | 1 | 1 | 1 |
| 196 | 1 | 0 | 0 | 0 | 0 | 0 | 1 | 1 | 1 |
| 197 | 0 | 1 | 0 | 0 | 0 | 0 | 1 | 1 | 1 |
| 198 | 1 | 1 | 0 | 0 | 0 | 0 | 1 | 1 | 1 |
| 199 | 0 | 0 | 1 | 1 | 0 | 0 | 1 | 1 | 1 |
| 200 | 1 | 0 | 1 | 1 | 0 | 0 | 1 | 1 | 1 |
| 201 | 0 | 1 | 1 | 1 | 0 | 0 | 1 | 1 | 1 |
| 202 | 0 | 0 | 0 | 0 | 0 | 0 | 1 | 1 | 1 |
| 203 | 1 | 0 | 0 | 0 | 0 | 0 | 1 | 1 | 1 |
| 204 | 0 | 1 | 0 | 0 | 0 | 0 | 1 | 1 | 1 |
| 205 | 1 | 1 | 0 | 0 | 0 | 0 | 1 | 1 | 1 |
| 206 | 0 | 0 | 1 | 1 | 0 | 0 | 1 | 1 | 1 |
| 207 | 0 | 0 | 0 | 0 | 1 | 1 | 1 | 1 | 1 |
| 208 | 1 | 0 | 0 | 0 | 1 | 1 | 1 | 1 | 1 |
| 209 | 0 | 1 | 0 | 0 | 1 | 1 | 1 | 1 | 1 |
| 210 | 1 | 1 | 0 | 0 | 1 | 1 | 1 | 1 | 1 |
| 211 | 0 | 0 | 1 | 1 | 1 | 1 | 1 | 1 | 1 |
| 212 | 1 | 0 | 1 | 1 | 1 | 1 | 1 | 1 | 1 |
| 213 | 0 | 1 | 1 | 1 | 1 | 1 | 1 | 1 | 1 |
| 214 | 0 | 0 | 0 | 0 | 1 | 1 | 1 | 1 | 1 |
| 215 | 1 | 0 | 0 | 0 | 1 | 1 | 1 | 1 | 1 |
| 216 | 0 | 1 | 0 | 0 | 1 | 1 | 1 | 1 | 1 |
| 217 | 1 | 1 | 0 | 0 | 1 | 1 | 1 | 1 | 1 |
| 218 | 0 | 0 | 1 | 1 | 1 | 1 | 1 | 1 | 1 |
| 219 | 1 | 0 | 1 | 1 | 1 | 1 | 1 | 1 | 1 |
| 220 | 0 | 1 | 1 | 1 | 1 | 1 | 1 | 1 | 1 |
| 221 | 1 | 1 | 1 | 1 | 1 | 1 | 1 | 1 | 1 |

FIG.9

| SUB-FIELD NO. | SF 1 | SF 2 | SF 3 | SF 4 | SF 5 | SF 6 | SF 7 | SF 8 | SF 1 | SF 2 | SF 3 | SF 4 | SF 5 | SF 6 | SF 7 | SF 8 | SF 1 | SF 2 | SF 3 | SF 4 | SF 5 | SF 6 | SF 7 | SF 8 |
|---|---|---|---|---|---|---|---|---|---|---|---|---|---|---|---|---|---|---|---|---|---|---|---|---|
| BIT NO. | B0 | B1 | B2 | B3 | B4 | B5 | B6 | B7 | B0 | B1 | B2 | B3 | B4 | B5 | B6 | B7 | B0 | B1 | B2 | B3 | B4 | B5 | B6 | B7 |
| LIGHT INTENSITY | 1 | 2 | 4 | 6 | 9 | 12 | 16 | 20 | 1 | 2 | 4 | 6 | 9 | 12 | 16 | 20 | 1 | 2 | 4 | 6 | 9 | 12 | 16 | 20 |
| 0 | 0 | 0 | 0 | 0 | 0 | 0 | 0 | 0 | | | | | | | | | | | | | | | | |
| 1 | 1 | 0 | 0 | 0 | 0 | 0 | 0 | 0 | | | | | | | | | | | | | | | | |
| 2 | 0 | 1 | 0 | 0 | 0 | 0 | 0 | 0 | | | | | | | | | | | | | | | | |
| 3 | 1 | 1 | 0 | 0 | 0 | 0 | 0 | 0 | | | | | | | | | | | | | | | | |
| 4 | 0 | 0 | 1 | 0 | 0 | 0 | 0 | 0 | | | | | | | | | | | | | | | | |
| 5 | 1 | 0 | 1 | 0 | 0 | 0 | 0 | 0 | | | | | | | | | | | | | | | | |
| 6 | 0 | 1 | 1 | 0 | 0 | 0 | 0 | 0 | 0 | 0 | 0 | 1 | 0 | 0 | 0 | 0 | | | | | | | | |
| 7 | 1 | 0 | 0 | 1 | 0 | 0 | 0 | 0 | 1 | 1 | 1 | 0 | 0 | 0 | 0 | 0 | | | | | | | | |
| 8 | 0 | 1 | 0 | 1 | 0 | 0 | 0 | 0 | | | | | | | | | | | | | | | | |
| 9 | 1 | 1 | 0 | 1 | 0 | 0 | 0 | 0 | 0 | 0 | 0 | 0 | 1 | 0 | 0 | 0 | | | | | | | | |
| 10 | 0 | 0 | 1 | 1 | 0 | 0 | 0 | 0 | 1 | 0 | 0 | 0 | 1 | 0 | 0 | 0 | | | | | | | | |
| 11 | 0 | 1 | 0 | 0 | 1 | 0 | 0 | 0 | 1 | 0 | 1 | 1 | 0 | 0 | 0 | 0 | | | | | | | | |
| 12 | 1 | 1 | 0 | 0 | 1 | 0 | 0 | 0 | 0 | 0 | 0 | 0 | 0 | 1 | 0 | 0 | 0 | 1 | 1 | 1 | 0 | 0 | 0 | 0 |
| 13 | 0 | 0 | 1 | 0 | 1 | 0 | 0 | 0 | 1 | 0 | 0 | 0 | 0 | 1 | 0 | 0 | 1 | 1 | 1 | 1 | 0 | 0 | 0 | 0 |
| 14 | 1 | 0 | 1 | 0 | 1 | 0 | 0 | 0 | 0 | 1 | 0 | 0 | 0 | 1 | 0 | 0 | | | | | | | | |
| 15 | 0 | 1 | 1 | 0 | 1 | 0 | 0 | 0 | 1 | 1 | 0 | 0 | 0 | 1 | 0 | 0 | 0 | 0 | 0 | 1 | 1 | 0 | 0 | 0 |
| 16 | 1 | 0 | 0 | 1 | 1 | 0 | 0 | 0 | 0 | 0 | 1 | 0 | 0 | 1 | 0 | 0 | 0 | 0 | 0 | 0 | 0 | 0 | 1 | 0 |
| 17 | 1 | 0 | 1 | 0 | 0 | 1 | 0 | 0 | 0 | 1 | 0 | 1 | 1 | 0 | 0 | 0 | 1 | 0 | 0 | 0 | 0 | 0 | 1 | 0 |
| 18 | 0 | 1 | 1 | 0 | 0 | 1 | 0 | 0 | 1 | 1 | 0 | 1 | 1 | 0 | 0 | 0 | 0 | 1 | 0 | 0 | 0 | 0 | 1 | 0 |
| 19 | 1 | 0 | 0 | 1 | 0 | 1 | 0 | 0 | 0 | 0 | 1 | 1 | 1 | 0 | 0 | 0 | 1 | 1 | 0 | 0 | 0 | 0 | 1 | 0 |
| 20 | 0 | 1 | 0 | 1 | 0 | 1 | 0 | 0 | 1 | 0 | 1 | 1 | 1 | 0 | 0 | 0 | 0 | 0 | 0 | 0 | 0 | 0 | 0 | 1 |
| 21 | 1 | 1 | 0 | 1 | 0 | 1 | 0 | 0 | 0 | 1 | 1 | 1 | 1 | 0 | 0 | 0 | 1 | 0 | 0 | 0 | 0 | 0 | 0 | 1 |
| 22 | 0 | 0 | 1 | 1 | 0 | 1 | 0 | 0 | 1 | 1 | 1 | 1 | 1 | 0 | 0 | 0 | 0 | 1 | 0 | 0 | 0 | 0 | 0 | 1 |
| 23 | 0 | 1 | 0 | 0 | 1 | 1 | 0 | 0 | 1 | 0 | 0 | 1 | 0 | 0 | 0 | 0 | 1 | 1 | 0 | 0 | 0 | 0 | 0 | 1 |
| 24 | 0 | 1 | 0 | 1 | 0 | 0 | 1 | 0 | 1 | 1 | 0 | 0 | 1 | 1 | 1 | 0 | 0 | 0 | 1 | 0 | 0 | 0 | 0 | 1 |
| 25 | 1 | 1 | 0 | 1 | 0 | 0 | 1 | 0 | 0 | 0 | 1 | 0 | 1 | 1 | 0 | 0 | 1 | 0 | 1 | 0 | 0 | 0 | 0 | 1 |
| 26 | 0 | 0 | 1 | 1 | 0 | 0 | 1 | 0 | 1 | 0 | 1 | 0 | 1 | 1 | 0 | 0 | 0 | 1 | 1 | 0 | 0 | 0 | 0 | 1 |
| 27 | 0 | 1 | 0 | 0 | 1 | 0 | 1 | 0 | 0 | 1 | 1 | 0 | 1 | 1 | 0 | 0 | 1 | 0 | 0 | 1 | 0 | 0 | 0 | 1 |
| 28 | 1 | 1 | 0 | 0 | 1 | 0 | 1 | 0 | 1 | 0 | 0 | 1 | 1 | 1 | 0 | 0 | 0 | 1 | 0 | 1 | 0 | 0 | 0 | 1 |
| 29 | 0 | 0 | 1 | 0 | 1 | 0 | 1 | 0 | 0 | 1 | 0 | 1 | 1 | 1 | 0 | 0 | 1 | 1 | 0 | 1 | 0 | 0 | 0 | 1 |
| 30 | 1 | 0 | 1 | 0 | 1 | 0 | 1 | 0 | 1 | 1 | 0 | 1 | 1 | 1 | 0 | 0 | 0 | 0 | 1 | 1 | 0 | 0 | 0 | 1 |
| 31 | 0 | 1 | 1 | 0 | 1 | 0 | 1 | 0 | 0 | 0 | 1 | 1 | 1 | 1 | 0 | 0 | 0 | 1 | 0 | 0 | 1 | 0 | 0 | 1 |
| 32 | 1 | 0 | 0 | 1 | 1 | 0 | 1 | 0 | 1 | 0 | 1 | 1 | 1 | 1 | 0 | 0 | 1 | 1 | 0 | 0 | 1 | 0 | 0 | 1 |
| 33 | 1 | 0 | 1 | 0 | 0 | 1 | 1 | 0 | 0 | 1 | 1 | 1 | 1 | 1 | 0 | 0 | 0 | 0 | 1 | 0 | 1 | 0 | 0 | 1 |
| 34 | 0 | 1 | 1 | 0 | 0 | 1 | 1 | 0 | 1 | 1 | 1 | 1 | 1 | 1 | 0 | 0 | 1 | 0 | 1 | 0 | 1 | 0 | 0 | 1 |
| 35 | 1 | 0 | 0 | 1 | 0 | 1 | 1 | 0 | 1 | 1 | 0 | 1 | 1 | 0 | 1 | 0 | 0 | 1 | 1 | 0 | 1 | 0 | 0 | 1 |
| 36 | 1 | 0 | 0 | 1 | 1 | 0 | 0 | 1 | 0 | 0 | 1 | 1 | 1 | 0 | 1 | 0 | 0 | 0 | 0 | 0 | 0 | 0 | 1 | 1 |
| 37 | 0 | 1 | 0 | 1 | 1 | 0 | 0 | 1 | 1 | 0 | 1 | 1 | 1 | 0 | 1 | 0 | 1 | 0 | 0 | 0 | 0 | 0 | 1 | 1 |
| 38 | 0 | 1 | 1 | 0 | 0 | 1 | 0 | 1 | 0 | 1 | 1 | 1 | 1 | 0 | 1 | 0 | 0 | 1 | 0 | 0 | 0 | 0 | 1 | 1 |
| 39 | 1 | 0 | 0 | 1 | 0 | 1 | 0 | 1 | 1 | 1 | 1 | 1 | 1 | 0 | 1 | 0 | 1 | 1 | 0 | 0 | 0 | 0 | 1 | 1 |
| 40 | 0 | 1 | 0 | 1 | 0 | 1 | 0 | 1 | 1 | 1 | 0 | 0 | 1 | 1 | 1 | 0 | 0 | 0 | 1 | 0 | 0 | 0 | 1 | 1 |
| 41 | 1 | 1 | 0 | 1 | 0 | 1 | 0 | 1 | 0 | 0 | 1 | 0 | 1 | 1 | 1 | 0 | 1 | 0 | 1 | 0 | 0 | 0 | 1 | 1 |
| 42 | 0 | 0 | 1 | 1 | 0 | 1 | 0 | 1 | 1 | 0 | 1 | 0 | 1 | 1 | 1 | 0 | 0 | 1 | 1 | 0 | 0 | 0 | 1 | 1 |
| 43 | 0 | 1 | 0 | 0 | 1 | 1 | 0 | 1 | 0 | 1 | 1 | 0 | 1 | 1 | 1 | 0 | 1 | 0 | 0 | 1 | 0 | 0 | 1 | 1 |
| 44 | 0 | 1 | 0 | 1 | 0 | 0 | 1 | 1 | 1 | 0 | 0 | 1 | 1 | 1 | 1 | 0 | 1 | 1 | 0 | 0 | 1 | 1 | 0 | 1 |
| 45 | 1 | 1 | 0 | 1 | 0 | 0 | 1 | 1 | 0 | 1 | 0 | 1 | 1 | 1 | 1 | 0 | 0 | 0 | 0 | 0 | 1 | 0 | 1 | 1 |
| 46 | 0 | 0 | 1 | 1 | 0 | 0 | 1 | 1 | 1 | 1 | 0 | 1 | 1 | 1 | 1 | 0 | 1 | 0 | 0 | 0 | 1 | 0 | 1 | 1 |
| 47 | 0 | 1 | 0 | 0 | 1 | 0 | 1 | 1 | 0 | 0 | 1 | 1 | 1 | 1 | 1 | 0 | 1 | 0 | 1 | 1 | 0 | 0 | 1 | 1 |
| 48 | 1 | 1 | 0 | 0 | 1 | 0 | 1 | 1 | 1 | 0 | 1 | 1 | 1 | 1 | 1 | 0 | 0 | 0 | 0 | 0 | 0 | 1 | 1 | 1 |
| 49 | 0 | 0 | 1 | 0 | 1 | 0 | 1 | 1 | 0 | 1 | 1 | 1 | 1 | 1 | 1 | 0 | 1 | 0 | 0 | 0 | 0 | 1 | 1 | 1 |

FIG.10

| | | | | | | | | | | | | | | | | | | | | | | | | |
|---|---|---|---|---|---|---|---|---|---|---|---|---|---|---|---|---|---|---|---|---|---|---|---|---|
| 50 | 1 | 0 | 1 | 0 | 1 | 0 | 1 | 1 | 1 | 1 | 1 | 1 | 1 | 1 | 1 | 0 | 0 | 1 | 0 | 0 | 0 | 1 | 1 | 1 |
| 51 | 0 | 1 | 1 | 0 | 1 | 0 | 1 | 1 | 0 | 0 | 1 | 1 | 1 | 1 | 0 | 1 | 1 | 1 | 0 | 0 | 0 | 1 | 1 | 1 |
| 52 | 1 | 0 | 0 | 1 | 1 | 0 | 1 | 1 | 1 | 0 | 1 | 1 | 1 | 1 | 0 | 1 | 0 | 0 | 1 | 0 | 0 | 1 | 1 | 1 |
| 53 | 1 | 0 | 1 | 0 | 0 | 1 | 1 | 1 | 0 | 1 | 1 | 1 | 1 | 1 | 0 | 1 | 0 | 1 | 0 | 1 | 1 | 0 | 1 | 1 |
| 54 | 0 | 1 | 1 | 0 | 0 | 1 | 1 | 1 | 1 | 1 | 1 | 1 | 1 | 1 | 0 | 1 | 1 | 1 | 0 | 1 | 1 | 0 | 1 | 1 |
| 55 | 1 | 0 | 0 | 1 | 0 | 1 | 1 | 1 | 0 | 1 | 1 | 1 | 1 | 0 | 0 | 1 | 0 | 0 | 1 | 1 | 1 | 0 | 1 | 1 |
| 56 | 0 | 1 | 0 | 1 | 0 | 1 | 1 | 1 | 1 | 1 | 1 | 1 | 1 | 0 | 0 | 1 | 1 | 0 | 1 | 1 | 1 | 0 | 1 | 1 |
| 57 | 1 | 1 | 0 | 1 | 0 | 1 | 1 | 1 | 0 | 1 | 1 | 1 | 1 | 0 | 1 | 1 | 0 | 0 | 0 | 0 | 1 | 1 | 1 | 1 |
| 58 | 0 | 0 | 1 | 1 | 0 | 1 | 1 | 1 | 1 | 1 | 1 | 1 | 1 | 0 | 1 | 1 | 1 | 0 | 0 | 0 | 1 | 1 | 1 | 1 |
| 59 | 0 | 1 | 0 | 0 | 1 | 1 | 1 | 1 | 1 | 0 | 1 | 1 | 0 | 1 | 1 | 1 | | | | | | | | |
| 60 | 1 | 1 | 0 | 0 | 1 | 1 | 1 | 1 | 0 | 1 | 1 | 1 | 0 | 1 | 1 | 1 | | | | | | | | |
| 61 | 0 | 0 | 1 | 0 | 1 | 1 | 1 | 1 | 1 | 1 | 1 | 1 | 0 | 1 | 1 | 1 | | | | | | | | |
| 62 | 1 | 0 | 1 | 0 | 1 | 1 | 1 | 1 | | | | | | | | | | | | | | | | |
| 63 | 0 | 1 | 1 | 0 | 1 | 1 | 1 | 1 | 0 | 0 | 0 | 1 | 1 | 1 | 1 | 1 | | | | | | | | |
| 64 | 1 | 0 | 0 | 1 | 1 | 1 | 1 | 1 | 1 | 1 | 1 | 0 | 1 | 1 | 1 | 1 | | | | | | | | |
| 65 | 0 | 1 | 0 | 1 | 1 | 1 | 1 | 1 | | | | | | | | | | | | | | | | |
| 66 | 1 | 1 | 0 | 1 | 1 | 1 | 1 | 1 | | | | | | | | | | | | | | | | |
| 67 | 0 | 0 | 1 | 1 | 1 | 1 | 1 | 1 | | | | | | | | | | | | | | | | |
| 68 | 1 | 0 | 1 | 1 | 1 | 1 | 1 | 1 | | | | | | | | | | | | | | | | |
| 69 | 0 | 1 | 1 | 1 | 1 | 1 | 1 | 1 | | | | | | | | | | | | | | | | |
| 70 | 1 | 1 | 1 | 1 | 1 | 1 | 1 | 1 | | | | | | | | | | | | | | | | |

FIG.11(a)

| SUB-FIELD NO. | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| BIT NO. | B0 | B1 | B3-1 | B4-1 | B5-1 | B6-1 | B7 | B6-2 | B5-2 | B4-2 | B3-2 | B2 |
| LIGHT INTENSITY (WEIGHT) | 1 | 2 | 4 | 8 | 16 | 24 | 64 | 24 | 16 | 8 | 4 | 4 |

FIG.11(b)

| SUB-FIELD NO. | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| BIT NO. | B0 | B1 | B3-1 | B4-1 | B5-1 | B7-1 | B6 | B7-2 | B5-2 | B4-2 | B3-2 | B2 |
| LIGHT INTENSITY (WEIGHT) | 1 | 2 | 4 | 8 | 16 | 32 | 48 | 32 | 16 | 8 | 4 | 4 |

FIG.11(c)

| SUB-FIELD NO. | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| BIT NO. | B0 | B1 | B3-1 | B4-1 | B5-1 | B6-1 | B7 | B6-2 | B5-2 | B4-2 | B3-2 | B2 |
| LIGHT INTENSITY (WEIGHT) | 1 | 2 | 3 | 6 | 10 | 17 | 54 | 16 | 10 | 6 | 4 | 4 |

FIG.11(d)

| SUB-FIELD NO. | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| BIT NO. | B0 | B1 | B3-1 | B4-1 | B5-1 | B6-1 | B6 | B7-2 | B5-2 | B4-2 | B3-2 | B2 |
| LIGHT INTENSITY (WEIGHT) | 1 | 2 | 3 | 6 | 10 | 27 | 33 | 27 | 10 | 6 | 4 | 4 |

FIG.12(a)

| SUB-FIELD NO. | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| BIT NO. | B0 | B1 | B2 | B3-1 | B4-1 | B5-1 | B6-1 | B7 | B6-2 | B5-2 | B4-2 | B3-2 |
| LIGHT INTENSITY (WEIGHT) | 1 | 2 | 4 | 4 | 8 | 16 | 24 | 64 | 24 | 16 | 8 | 4 |

FIG.12(b)

| SUB-FIELD NO. | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| BIT NO. | B0 | B1 | B2 | B3-1 | B4-1 | B5-1 | B7-1 | B6 | B7-2 | B5-2 | B4-2 | B3-2 |
| LIGHT INTENSITY (WEIGHT) | 1 | 2 | 4 | 4 | 8 | 16 | 32 | 48 | 32 | 16 | 8 | 4 |

FIG.12(c)

| SUB-FIELD NO. | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| BIT NO. | B0 | B1 | B2 | B3-1 | B4-1 | B5-1 | B6-1 | B7 | B6-2 | B5-2 | B4-2 | B3-2 |
| LIGHT INTENSITY (WEIGHT) | 1 | 2 | 4 | 3 | 6 | 10 | 17 | 54 | 16 | 10 | 6 | 4 |

FIG.12(d)

| SUB-FIELD NO. | SF1 | SF2 | SF3 | SF4 | SF5 | SF6 | SF7 | SF8 | SF9 | SF10 | SF11 | SF12 |
|---|---|---|---|---|---|---|---|---|---|---|---|---|
| BIT NO. | B0 | B1 | B2 | B3-1 | B4-1 | B5-1 | B7-1 | B6 | B7-2 | B5-2 | B4-2 | B3-2 |
| LIGHT INTENSITY (WEIGHT) | 1 | 2 | 4 | 3 | 6 | 10 | 27 | 33 | 27 | 10 | 6 | 4 |

$S_{c1}$, $S_{c2}$ ···, $S_{cj}$ : SCAN ELECTRODES
$S_{u1}$, $S_{u2}$, ···, $S_{uj}$ : SUSTAINING ELECTRODES
D1, D2 ···, Dk : DATA ELECTRODES

15 : PDP PANEL
16 : DISPLAY CELL

FIG.18

| SUB-FIELD NO. | SF1 | SF2 | SF3 | SF4 | SF5 | SF6 | SF7 | SF8 |
|---|---|---|---|---|---|---|---|---|
| BIT NO. | B0 | B1 | B2 | B3 | B4 | B5 | B6 | B7 |
| LIGHT INTENSITY | 1 | 2 | 4 | 8 | 16 | 32 | 64 | 128 |
| 0 | 0 | 0 | 0 | 0 | 0 | 0 | 0 | 0 |
| ~ | | | | | | | | |
| 63 | 1 | 1 | 1 | 1 | 1 | 1 | 0 | 0 |
| 64 | 0 | 0 | 0 | 0 | 0 | 0 | 1 | 0 |
| ~ | | | | | | | | |
| 127 | 1 | 1 | 1 | 1 | 1 | 1 | 1 | 0 |
| 128 | 0 | 0 | 0 | 0 | 0 | 0 | 0 | 1 |
| ~ | | | | | | | | |
| 191 | 1 | 1 | 1 | 1 | 1 | 1 | 0 | 1 |
| 192 | 0 | 0 | 0 | 0 | 0 | 0 | 1 | 1 |
| ~ | | | | | | | | |
| 255 | 1 | 1 | 1 | 1 | 1 | 1 | 1 | 1 |

GRAY SCALE EXPRESSION METHOD AND GRAY SCALE DISPLAY DEVICE

BACKGROUND OF THE INVENTION

The present invention relates to a gray scale expression method for use in a display device and, particularly, to a gray scale expression method adequate to suppress pseudo contours of moving images in displaying gray scale on a flat type display device such as plasma display panel and a gray scale display device using the same method.

In general, a plasma display panel (referred to as "PDP", hereinafter) has many merits such as thin structure, free from flicker, large display contrast ratio, possibility of providing a relatively large screen, high response speed and possibility of multi-color emission by utilizing fluorescent material of self emission type, etc., and, recently, its use in such fields as display devices related to computer and color image display is becoming popular.

The PDP can be classified, according to an operation system thereof, to an AC discharge type in which electrodes are coated with dielectric material and are operated in an indirect AC discharging state and a DC discharge type in which electrodes are exposed in a discharge space and operated in a direct discharge state. The AC discharge type PDP is further classified, according to a drive system, to a memory operation type which utilizes a discharge cell memory and a refresh operation type which does not utilize such memory. Incidentally, light intensity of the PDP is substantially proportional to a discharge frequency, that is, a repetition frequency of pulse voltage. Since light intensity of the refresh type PDP is lowered when its display capacity becomes large, the refresh type PDP is mainly used for small display capacity.

FIG. 14 is a cross section of an example of the A.C. discharge memory operation type PDP, showing a construction of a display cell schematically. The display cell a rear insulating substrate 1 and a front insulating substrate 2, both of which are of glass, a transparent scan electrode 3 formed on an inner surface of the front insulating substrate 2, a transparent sustaining electrode 4 also formed on the inner surface of the front insulating substrate 2, trace electrodes 5 and 6 formed on surfaces of the scan electrode 3 and the sustaining electrode 4 in order to reduce electrode resistances, respectively, a data electrode 7 formed on an inner surface of the rear insulating substrate 1 perpendicularly to the scan electrode 3 and the sustaining electrode 4, a discharge gas space 8 provided between the insulating substrates 1 and 2 and filled with a discharge gas such as helium, neon or xenon or a mixture of them, partition walls 9 for maintaining the discharge gas space 8 and partitioning between display cells, a fluorescent material 11 for converting ultra-violet ray generated by a discharge of the discharge gas in the space 8 into a visible light 10, a dielectric member 12 covering the scan electrode 3 and the sustaining electrode 4, a protective layer 13 formed of magnesium oxide, etc., for protecting the dielectric member 12 against discharge and a dielectric member 14 covering the data electrode 7.

A discharge operation of a selected display cell will be described with reference to FIG. 14. When a discharge is started by applying a pulse voltage exceeding a discharge threshold value across the scan electrode 3 and the data electrode 4, positive and negative electric charges are attracted to the respective dielectric members 12 and 14 and accumulated thereon correspondingly to the polarity of this pulse voltage. Since an internal voltage equivalent to the accumulated charge, that is, the wall voltage, has a polarity opposite to the polarity of the pulse voltage, an effective voltage within the cell is lowered with growth of discharge and it becomes impossible to sustain the discharge even when the pulse voltage is kept constant. Thus, the discharge is ultimately stopped. Thereafter, when a sustaining pulse which is a pulse voltage having the same polarity as that of the wall voltage is applied across the scan electrode 3 and the sustaining electrode 4, it is possible to discharge even if the voltage amplitude of the sustaining pulse is small, since the wall voltage is added to the sustaining pulse voltage as an effective voltage, resulting in a drive voltage exceeding the discharge threshold value.

Therefore, it becomes possible to maintain discharge by continuously applying the sustaining pulse across the scan electrode 3 and the sustaining electrode 4. This function is the above mentioned memory function. Further, it is possible to stop the sustaining discharge by applying a low voltage pulse having large width or an erase pulse having a small width similar to the sustaining pulse voltage across the scan electrode 3 and the sustaining electrode 4 such that the wall voltage is neutralized.

FIG. 15 shows conventional drive waveforms such as disclosed in SOCIETY FOR INFORMATION DISPLAY INTERNATIONAL SYMPOSIUM DIGEST OF TECHNICAL PAPERS VOLUME XXVI, pp807, for driving a plasma display panel having a structure such as shown in FIG. 16.

The panel shown in FIG. 16 is for a dot matrix display panel including j (column electrodes)×k (line electrodes). That is, the panel includes scan electrodes Sc1, Sc2, . . . , Scj and sustaining electrodes Su1, Su2, . . . , Suj arranged in parallel to the respective scan electrodes, as the column electrodes and data electrodes D1, D2, . . . , Dk arranged perpendicularly to each of the column electrodes, as the line electrodes.

In FIG. 15, a sustaining electrode drive waveform Wu applied commonly to the sustaining electrodes Su1, Su2, . . . , Suj, scan electrode drive waveforms Ws1, Ws2, . . . , Wsj applied to the respective scan electrodes Sc1, Sc2, . . . , Scj and a data electrode drive waveform Wd applied to the data electrode Di are shown, where $1 \leqq i \leqq k$. A drive period includes a preliminary discharge period A, a write discharge period B and a sustaining discharge period C and a desired image display is obtained by repeating the drive period.

The preliminary discharge period A includes a preliminary discharge pulse Pp for discharging all of the display cells of the PDP panel 15 and preliminary discharge erase pulses $Pp_e$ for extinguishing charges among the wall charges produced by the application of the preliminary discharge pulse, which impedes the write discharge and the sustaining discharge. In the preliminary discharge period A, active particles and the wall charges which are necessary to obtain a stable write discharge characteristics in the write discharge period B are produced in the discharge gas space.

In the sustaining discharge period C, in order to obtain desired light intensity of the display cells which are subjected to the write discharge in the write discharge period B, the discharges of the display cells are sustained.

In the preliminary discharge period A, the preliminary discharge pulse Pp is supplied to the sustaining electrodes Su1, Su2, . . . , Suj to discharge all of the display cells. Then, the erase pulses $Pp_e$ are applied to the scan electrodes Sc1, Sc2, . . . , Scj to produce erase discharges therein to thereby erase the wall charges accumulated by the preliminary discharge pulse.

Thereafter, in the write period B, the scan pulse Pw is applied to the scan electrodes Sc1, Sc2, . . . , Scj in line-sequence and the data pulse Pd is selectively applied to the data electrodes Di correspondingly to video display data, to produce discharges in the display cells to be displayed to thereby produce the wall charges.

Finally, in the sustaining discharge period C, the discharges of only the display cells in which the write discharges occur are sustained by the sustaining pulses Pc and Ps, completing a light emitting operation of the whole PDP panel.

A conventional sub-field display scheme for 64 gray levels, in which the scanning and sustaining drives are performed separately and which is utilized in an AC color plasma display, will be briefly described with reference to FIG. 17(*a*). One TV field which is usually in the order of one-sixtieth second (about 16.7 ms) at which flicker is negligible is divided into 6 sub-fields SF1~SF6 as shown in FIG. 17(*a*), each sub-field consisting of a scan period and a sustaining period.

In the scanning period of the sub-field SF1 of the sub-fields SF1~SF6, the write operation is performed for the respective pixels on the basis of display data of B5 which is the most significant bit number. After the write operation for the whole PDP panel completes, the sustaining discharge pulse is applied to the whole panel to emit light from only the written pixels. Then, the same drive is performed in the sub-field SF5, and so on. In order to obtain sufficient amount of light emission in the sustaining discharge periods of the respective sub-fields, the sustaining pulse is applied, for example, 256 times in the sub-field SF6, 128 times in the sub-field SF5, 64 times in the sub-field SF4, 32 times in the sub-field SF3, 16 times in the sub-field SF2 and 8 times in the sub-field SF1.

The above mentioned operation is basically the same as that shown in FIG. 17(*b*) which shows another conventional sub-field display scheme of a mixed scanning/sustaining drive type in which the write/erase scanning and the sustaining discharging are performed simultaneously or of a mixed drive type in which the scanning/sustaining are performed across adjacent sub-fields. Such sub-field scheme has to be employed due to the necessity of modulation of intensity of emitted light with the number of light emissions or the light emitting period and, in order to scan a plurality of times in each sub-field necessarily, the sub-field scheme requires a high speed scan and write operations within a short time. However, with the recent improvement of the write performance of the plasma display panel, a high speed write operation has become possible even at 3 microseconds or shorter and a full color display with 256 gray levels has been realized by using an 8 sub-field system.

Although such sub-field system is adequate to display still images, it has been found that disturbances of gradation are often observed when displaying moving images, dependent on image. For example, in a case where an image such as a human cheek having a slow spatial variation of gray levels moves on a display screen, pseudo contours which are darker or brighter or different in color from that of the cheek may appear on a portion of the cheek which is to be a smooth image. Further, there may also occur color separation or reduction of resolution. Such pseudo contours or gradation disturbances of moving images are very conspicuous in boarder regions of a smoothly varying gradation where gray levels jump up to higher bits, resulting in substantial degradation of display quality and image quality.

FIG. 18 shows a portion of gradation realized by combinations of 8 sub-fields SF1~SF8 weighted respectively by light intensities 128, 64, 32, 16, 8, 4, 2 and 1 corresponding to respective binary numbers each consisting 8 bits B7, B6, B5, B4, B3, B2, B1 and B0. By combining these sub-fields, it becomes possible to display 256 gray levels. That is, the light intensity of each of the 256 gray levels of each pixel can be realized by a binary number of 8 bits, B7~B0. Images are sequentially displayed by the sub-fields SF1~SF8 whose existence or absence of light intensities 128, 64, 32, 16, 8, 4, 2 and 1 is represented by binary numbers of the bits B7~B0, resulting in a natural image expressed by intermediate gray levels obtained by the integration effect of human eyes.

In FIG. 18, particularly, in a case where light intensity is varied by one gray level from 127 to 128, values of all of B6 to B0 are changed from "1" to "0" and a value of B7 is changed from "0" to "1". Therefore, when a PDP is activated in time from the lowest sub-field SF1 to the highest sub-field SF8 in the order, the light emitting period is substantially changed from a former half portion of a field to a later half thereof, resulting in the pseudo contours of moving images.

In order to solve this problem, a number of methods have been proposed. In Takigawa, "TV Display by AC Plasma Panel", the journal of Electronics & Communications Association of Japan, 77/Vol. J60-A, No. 1, pp. 56 to 62, it is described that it is effective to arrange sub-fields such that an average of light intensity within a time corresponding to one field becomes small at times preceding and succeeding to a shift-up or shift-down of bit and, in a case of display with 5 bits, that is, in 32 gray levels, a sub-field arrangement of SF3, SF2, SF1, SF5, SF4 with a light emitting period of higher bit being arranged in a center portion is effective to suppress pseudo contours of moving images. Further, it is also effective for the same purpose to reduce a display time within one field and, according to experiments conducted by him, a good display is realized by shortening the display period to one fourth of one field in the above sub-field arrangement.

Further, in A. Kohgami, "Gray Scale Display System of TV using Memory Type Gas Discharge Panel", Technical Report of Electronic Information Communications Association of Japan, EID90-9, 1990, it is described that pseudo contours of moving images can be improved by making a time interval from a first bit of a field to a last bit of a succeeding field within 20 milliseconds corresponding to a critical flicker frequency of human visual organ. Kohgami also describes that such time interval of 20 milliseconds or shorter can be realized by not arranging sub-fields throughout one field but arranging them dense in one side portion of the field similarly to the above mentioned Takigawa method.

Kohgami further describes that the above condition can also be satisfied by dividing and arranging high significant bits having long light emitting period. In a case of a 8-bit display, it is possible to realize the time of 18.8 milliseconds from the first bit of one field to a last bit of a next field by dividing the most significant bit B7 by 2 to obtain sub-fields SF8-1 and SF8-2, dividing a next significant bit B6 by 2 to obtain sub-field SF7-1 and SF7-2 and arranging the sub-fields SF8-1, SF8-2, SF7-1 and SF7-2 thus obtained discretely to constitute one field consisting of 10 sub-fields arranged in the order of SF7-1, SF8-1, SF1, SF2, SF3, SF4, SF5, SF6, SF7-2 and SF8-2, resulting in improved gray scale expression of moving images.

It should be noted that, in the present invention, the expression generally used in the field of the information processing is used such that the least significant bit, n-th significant bit and the lowest sub-field are expressed by B0, Bn−1 and SF1, respectively, although, in Kohgami, the most significant bit of a binary number representing the weight of light intensity is made Bl and the most significant sub-field corresponding thereto is made SF1.

There are other proposals for improvement on the contour disturbances of moving images by means of optimization of the arrangement of sub-fields. In Japanese Patent Application Laid-open No. H3-145691, a sub-field of a bit next to the most significant bit and a sub-field of a bit succeeding to the next bit are arranged on both sides of a sub-field of the most significant bit.

In Japanese Patent Application Laid-open No. H7-7702, a sub-field of the most significant bit is arranged in a center position and sub-fields of a next bit next to the most significant bit and a bit next to the next bit are arranged in opposite ends of a field which is separated in time from the sub-field of the most significant bit so as to disperse these sub-fields as far as possible.

Further, in Japanese Patent Application laid-open No. H7-271325, for 64 gray levels, pseudo contours of moving images, which occur when light intensity weighted with binary number is shifted up, is slightly suppressed by preparing three sub-fields (SF4-1, SF4-2, SF4-3) each of light intensity level of 8 and two sub-fields (SF5-1, SF5-2) each of light intensity level of 16 and, in displaying a light intensity in a range from light intensity level 16 to 23 and a range from light intensity level 48 to 55, producing gradation by switching between a first sub-field arrangement in which SF4-1 is selected and a second sub-field arrangement in which SF4-2 is selected, every scan line or every pixel.

Further, in K. Toda, et al., "A Modified-Binary-Coded Light-Emission Scheme for Suppressing Gray Scale Disturbances of Moving Images", ASIA DISPLAY'95, Oct. 17, 1995, pp. 947 to 948, a sub-field construction is proposed in which, for 256 gray levels, two sub-fields each weighted with a binary number corresponding to light intensity of 48 are arranged on each side of 6 sub-fields weighted with binary numbers corresponding to light intensity level of 1, 2, 4, 8, 16 and 32, respectively. Although the proposed sub-field arrangement substantially relaxes time variation in shift-up operation of bits, there are problems that it requires a number, as large as 10, of sub-fields for 256 gray levels and there is no suppression effect of pseudo contours of moving images with gray level change from light intensity of 31 to 32. This is because the proposed sub-field arrangement is based on the dispersion of light intensity from the upper sub-fields and an information which can be expressed by 10 bits is-not utilized effectively.

Among the conventional techniques mentioned hereinbefore, the method utilizing the optimization of the sequence of sub-fields is not sufficient for a high quality video image display since pseudo contours of moving images is not suppressed enough. Further, in order to obtain a sufficient suppression effect for the pseudo contours of moving images, it is necessary in the method in which the field time or display period is shortened or a number of sub-fields are divided to substantially shorten the scan period. This requirement can be satisfied by a plasma display having a display capacitance which is small enough to allow a sufficiently long scan period. However, a multi-level display of moving images is desired by a display having rather large display capacitance and it is difficult to drive such display with further substantial reduction of scan period.

That is, pseudo contours of moving images occur due to unevenness of shift time in shifting up by one gray level in the gray scale display method for displaying gray scale by combining a plurality of sub-fields light intensities of which are weighted by binary numbers. Conventionally, such unevenness of shift time is dispersed by employing special sub-field arrangement or division of upper sub-fields. However, there is no procedure taken to completely remove the time variation which is the cause of pseudo contours of moving images and, therefore, the effect of conventional method is limited. The time unevenness resides in the sub-field method using weighting light intensity with binary numbers and, unless this is solved, the problems inherent to the conventional methods can not be solved.

SUMMARY OF THE INVENTION

An object of the present invention is to provide a gray scale display method capable of substantially suppressing pseudo contours appearing in moving images and a gray scale display device for performing the same method.

In order to achieve the above object, according to the present invention, a gray scale display method for displaying gray scale by dividing one field period into sub-fields and combining the sub-fields, is featured by including a plurality of sub-fields having light intensity levels, a difference in light intensity level between two of the plurality of the sub-fields which are adjacent in light intensity level is substantially a constant value.

Further, a gray scale display device according to the present invention for performing the gray scale display method for displaying gray scale by dividing one field period into sub-fields and combining the sub-fields is featured by comprising a light intensity information converter circuit which, in response to a light intensity information of sub-fields having light intensities weighted by binary numbers and the binary numbers consisting of a plurality of bits expressing weights of light intensities of a plurality of sub-fields, outputs a light intensity information expressing weights with which a difference in light intensity between two of the plurality of the sub-fields which are adjacent in light intensity level becomes substantially a constant value.

In the gray scale display method and the gray scale display device according to the present invention, a shift-up of light intensity is made only one bit by making light intensities of a plurality of sub-fields arranged in the light intensity order an arithmetic progression. Therefore, the unevenness of time in shifting up the light intensity, which is the problem inherent to the sub-field arrangements in the conventional gray scale display method in which the light intensities are weighted by binary numbers, is substantially relaxed and, as a result, pseudo contours of moving images are suppressed substantially.

Further, since, according to the present invention, pseudo contours of moving images can be suppressed by using only one or two sub-fields additionally, it is possible to reduce power consumption of the gray scale display device.

BRIEF DESCRIPTION OF THE DRAWINGS

FIG. 1 is a table for explaining a gray scale display method according to a first embodiment of the present invention;

FIG. 3 is a table for explaining a gray scale display method according to a second embodiment of the present invention;

FIG. 4 is a table for explaining a gray scale display method according to a third embodiment of the present invention;

FIG. 5 is a table for explaining a gray scale display method according to a fourth embodiment of the present invention;

FIGS. 6 and 7 are a table for explaining a gray scale display method according to a fifth embodiment of the present invention;

FIGS. 9 and 10 are a table for explaining a gray scale display method according to a sixth embodiment of the present invention;

FIGS. 11(*a*) to 11(*d*) are tables for explaining sub-fields based on a seventh embodiment of the present invention;

FIGS. 12(*a*) to 12(*d*) are tables for explaining sub-fields based on an eighth embodiment of the present invention;

FIG. 18 is a table for explaining a conventional gray scale display method.

DETAILED DESCRIPTION OF THE PREFERRED EMBODIMENTS

Preferred embodiments of the present invention will be described in detail with reference to the drawings.

Figure 13:
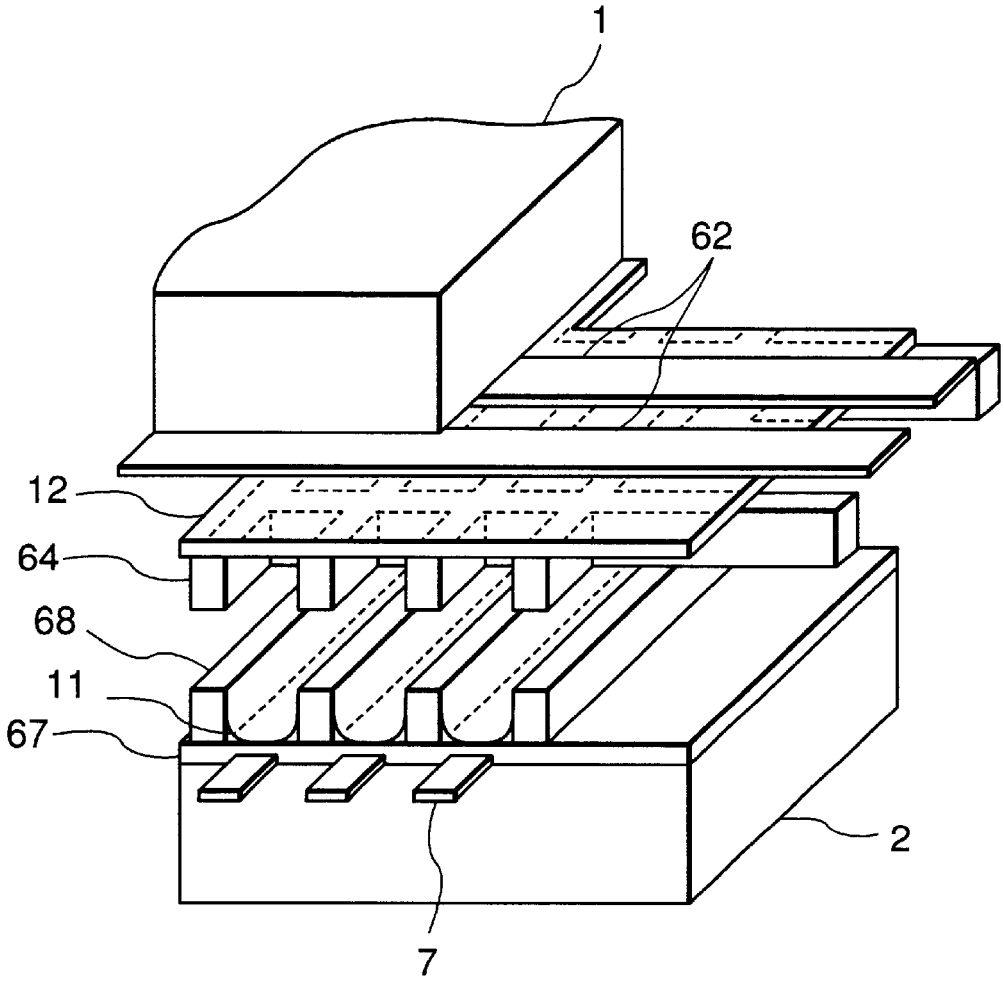
FIG. 13 is a disassembled perspective view showing a structure of a plasma display panel (PDP) used in the embodiments of the present invention.
Figure 14:
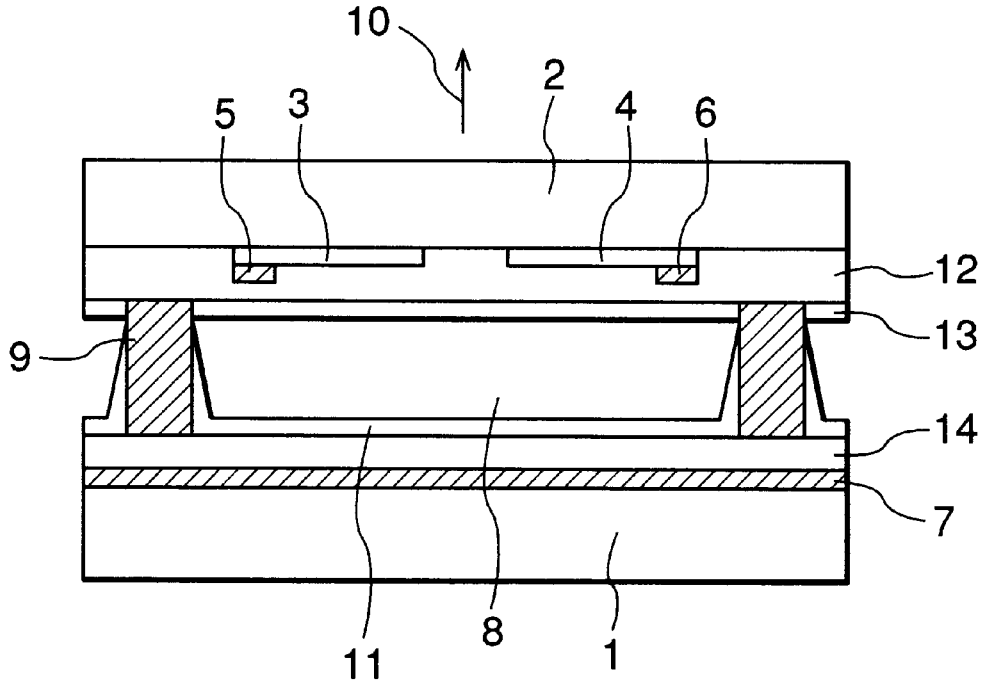
FIG. 14 is a cross section showing a construction of one of display cells of an AC memory type PDP.
Figure 15:
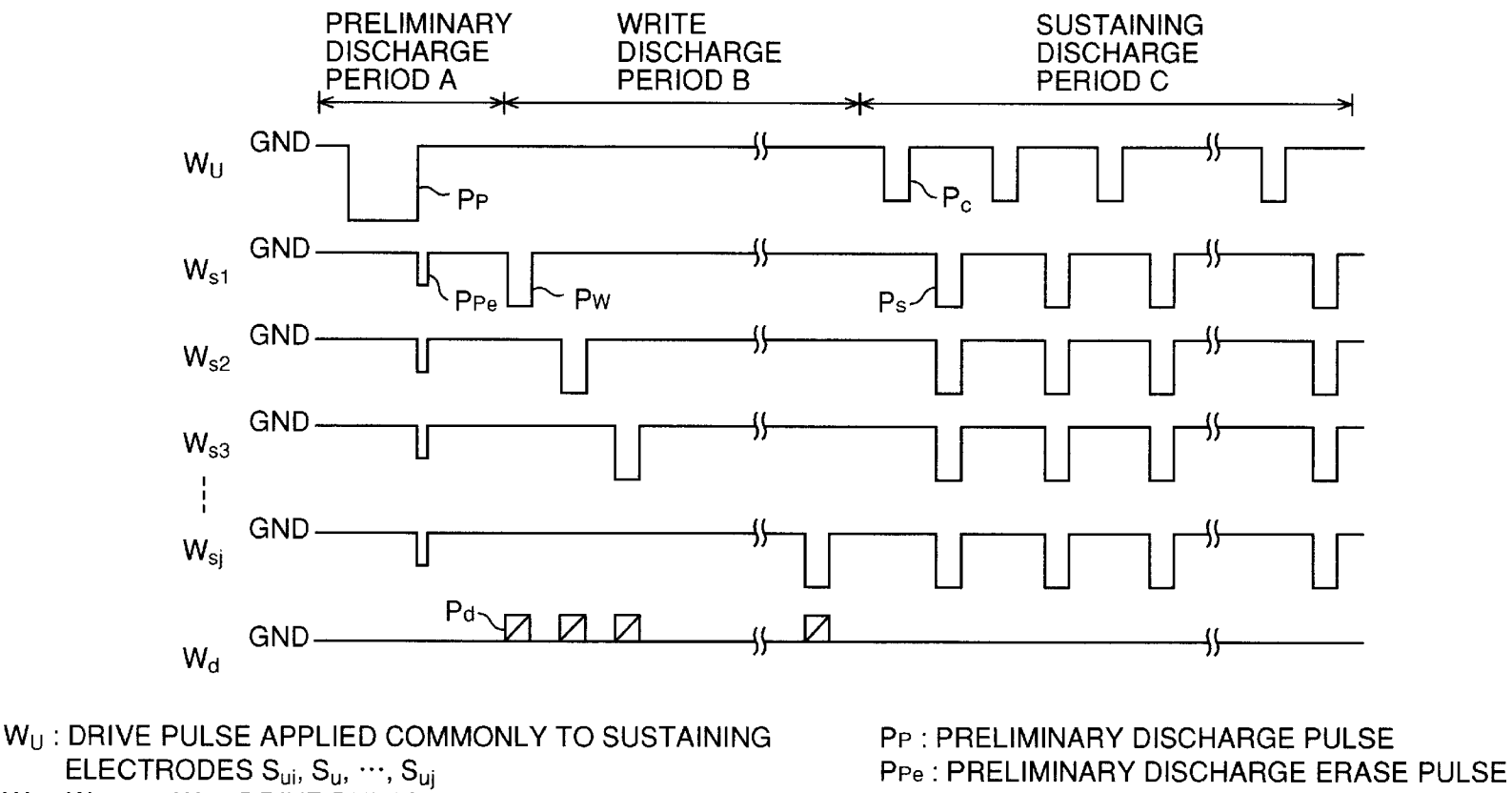
FIG. 15 shows waveforms in various portions of a conventional PDP drive circuit.
Figure 16:
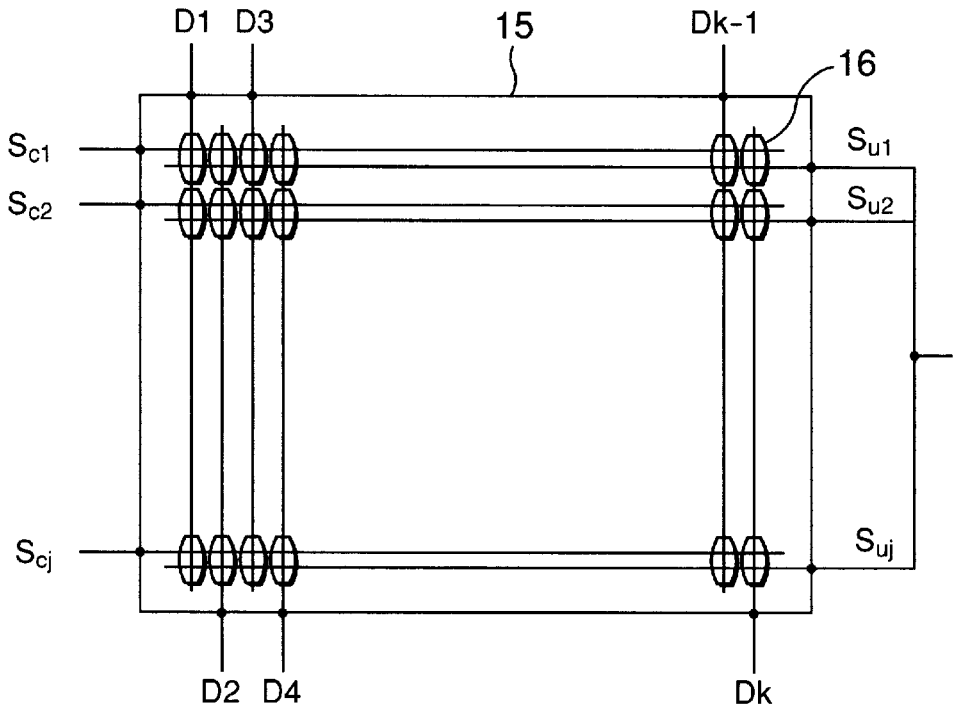
FIG. 16 is a plan view showing an electrode arrangement of the AC memory type PDP.
Figure 17A:
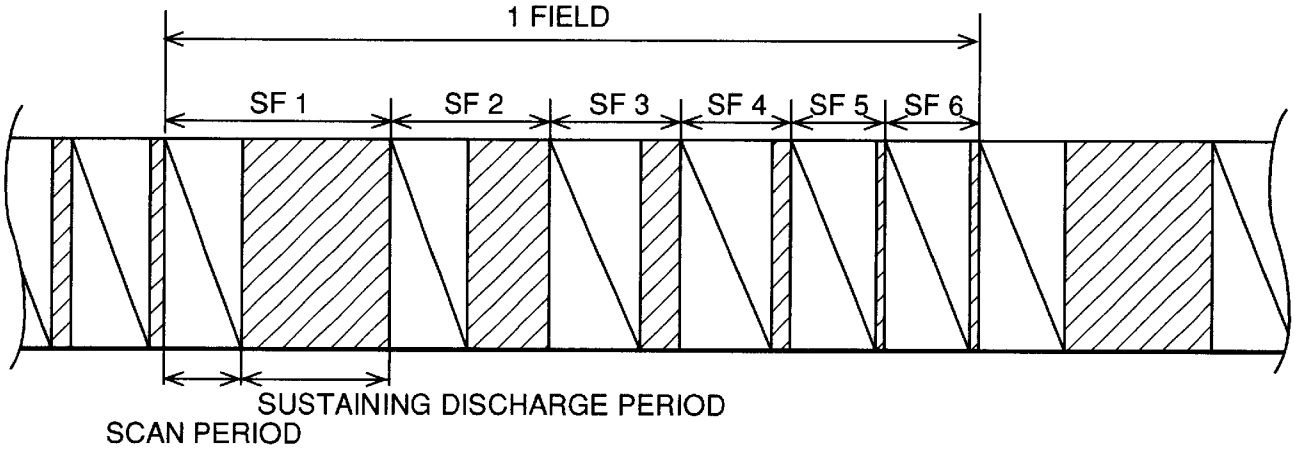
FIGS. 17(*a*) and (*b*) show a conventional sub-field system for gray scale display.
Figure 17B:
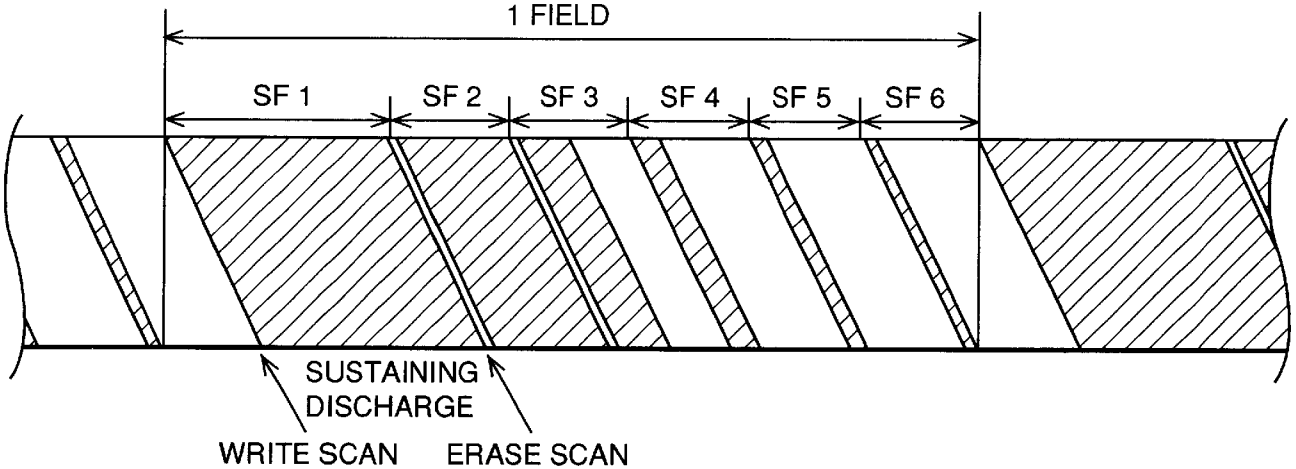

FIG. 13 shows a plasma display panel for 640×480 color image display. On a lower surface of a glass substrate 1 on a display side, plane discharge electrodes 62 formed from transparent electrically conductive films each laminated with a metal bus electrode are formed and, on lower surfaces of the surface discharge electrodes 62, a dielectric layer 12 is formed. Further, on a lower surface of the dielectric layer 12, a black colored and lattice shaped partition wall 64 defining pixels is formed.

On an upper surface of a glass substrate 2 on a rear side, data electrodes 7 extending perpendicularly of the plane discharge electrodes, a white colored glaze layer 67 and white colored, parallel partition walls 68 having parallel grooves between adjacent ones thereof are formed in the order. A width of the groove between adjacent ones of the partition walls 68 is substantially equal to a distance between adjacent ones of lattices of the partition wall 64 in one direction. Inside surfaces of the grooves of the partition walls 68 are painted with a fluorescent material 11 which is capable of emitting three primary colors.

The panel is completed by assembling the above mentioned components and filling a space between the glass substrates 1 and 2 with a discharge gas consisting of helium (He), neon (Ne) and xenon (Xe). The number of the data electrodes 7 is 1920 and the number of the surface discharge electrodes 62 is 480 each consisting of a scan electrode and a sustaining electrode.

Scan pulses are applied to the scan electrodes sequentially and data pulses are applied to the data electrodes 7 selected in synchronism with the application of the scan pulses. After this line-sequential scan is performed throughout the panel, a sustaining discharge is performed throughout the panel surface, resulting in a color light emission. A display of a moving image having gray levels is performed by performing this operation in a plurality of sub-fields correspondingly to digitized gray scale data in a field period of 1/60 seconds.

FIG. 1 is a table showing a gray scale display method according to a first embodiment of the present invention. The table shown in FIG. 1 shows combinations of 9 sub-fields SF1 to SF9 obtained by dividing one field, which express respective 256 gray levels. Although, in the example shown in FIG. 1, only upper sub-fields SF5 to SF9 are shown, it should be noted that light intensities of lower sub-fields SF1 to SF4 are weighted with usual binary numbers as in the case shown in FIG. 18. That is, the sub-fields SF1, SF2, SF3 and SF4 are weighted to light intensities 1, 2, 4 and 8 correspondingly to bit numbers B0, B1, B2 and B3, respectively. Light intensities in a range from 0 to 15 are expressed by combining these four sub-fields SF1, SF2, SF3 and SF4.

In this embodiment, light intensity weights of 16, 32, 48, 64 and 80 corresponding to the bits B4, B5, B6, B7 and B8 are assigned to the upper five sub-fields SF5, SF6, SF7, SF8 and SF9, respectively. That is, these sub-fields are weighted in an arithmetic progression having constant, that is, a difference in light intensity between adjacent sub-fields, of substantially 16.

In concrete, light intensity of the fifth sub-field SF5 is 16, that of the sixth sub-field SF6 is 32 obtained by adding the constant of 16 to the light intensity of the sub-field SF5, that of the seventh sub-field SF7 is 48 obtained by adding the constant of 16 to the light intensity of 32 of the sub-field SF6, that of the eighth sub-field SF8 is 64 obtained by adding the constant of 16 to the light intensity of 48 of the sub-field SF7 and that of the ninth sub-field SF9 is 80 obtained by adding the constant of 16 to the light intensity of 64 of the sub-field SF8. Further, the gray scale corresponding to the constant of 16 is expressed by the lower sub-fields SF1 to SF4, so that a continuous gray scale is expressed without any discontinuity, together with the upper sub-fields.

Therefore, the change of light emitting period when the light intensity is changed by one gray level from level 63 to level 64, from level 127 to level 128 and from level 191 to level 192 which is a problem when the light intensity is conventionally weighted with binary numbers corresponds, in this embodiment, to a mere shift of the light emission in a certain sub-field to another sub-field adjacent thereto. That is, in this embodiment, the change of light intensity from 63 to 64 corresponds to the mere shift of light emission in the sub-field SF6 to the adjacent sub-field SF7.

Further, the change of light intensity from 127 to 128 with which the maximum pseudo contours of moving images occurs can be realized by merely shifting light emission in the sub-field SF6 to the sub-field SF7. Further, the change of light intensity from 191 to 192 can be realized by the mere shift of light emission in the sub-field SF7 to the sub-field SF8. Although the changes of light intensity in the lower four sub-fields are the same as those in the conventional technique, these changes can be negligible since the light emitting periods of the lower four sub-fields are very short.

As described, when the weighting of the respective upper sub-fields is determined such that the light intensities thereof becomes an arithmetic progression, the change in the case of shift-up of the upper sub-field is only one level and it is possible to determine a hamming distance at the one level change as 1. Further, redundancy of information is increased and one light intensity can be expressed by one of a plurality of combinations of the bits B4 to B8. FIG. 1 shows a first group of expressions, a second group of expressions and a third group of expressions. Although the light intensities from 0 to 47 and the light intensities from 208 to 255 can be expressed by only the first group of expressions, the light intensities from 48 to 79 and those from 176 to 207 can be expressed by either of the first group of expressions or the second group of expressions and the light intensities from 80 to 175 can be expressed by any of the first, second and third groups of expressions. The first group of expressions of the light intensities from 48 to 207, which can also be expressed by the second and/or third groups of expressions, are selected such that the upper change is smaller than those of the expression "01000" of the light intensities from 32 to 47 as well as the expression "10111" of the light intensities from 208 to 223. Therefore, it is clear from FIG. 1 that the change of sub-field at the level change can be made smaller and the contour degradation of moving images can be restricted. Incidentally, it is possible to select expressions from the second and third groups whose changes of light intensities at the level changes are not so different from those of the first group of expressions.

Further, it is possible to arrange the lower sub-fields SF1, SF2, SF3 and SF4 having light intensities weighted by binary numbers in not only the increasing order but also the decreasing order, or to disperse them on both sides of the upper sub-fields from SF5 to SF9 or concentrate them in the center.

Further, it is possible to divide each of some upper sub-fields by two and arrange these sub-fields symmetrically in time. For example, it is possible to further reduce the gravity center shift at the level change to thereby substantially suppress pseudo contours of moving images by dividing the SF8 having light intensity weighted by 64 and the sub-field SF7 having light intensity weighted by 48 into sub-fields SF8-1 and SF8-2 whose light intensities are weighted by 32 and sub-fields SF7-1 and SF7-2 whose light intensities are weighted by 24, respectively, and arranging these sub-fields in the order of SF7-1, SF8-1, SF9, SF8-2, SF7-2.

Further, it is possible to suppress pseudo contours of moving images more effectively by suitably selecting the expressions of the first, second and third groups by means of pixels, scan lines, fields, frames, etc.

The weighting of light intensities-by the arithmetic progression has been described. However, even if the weighting is not performed with the exact constant of the arithmetic progression, substantially the same effect can be obtained when a light intensity of a sub-field is within a range from a value smaller than two times a light intensity of a lower sub-field adjacent to the sub-field to a value exceeding the light intensity of the lower sub-field.

Figure 2:
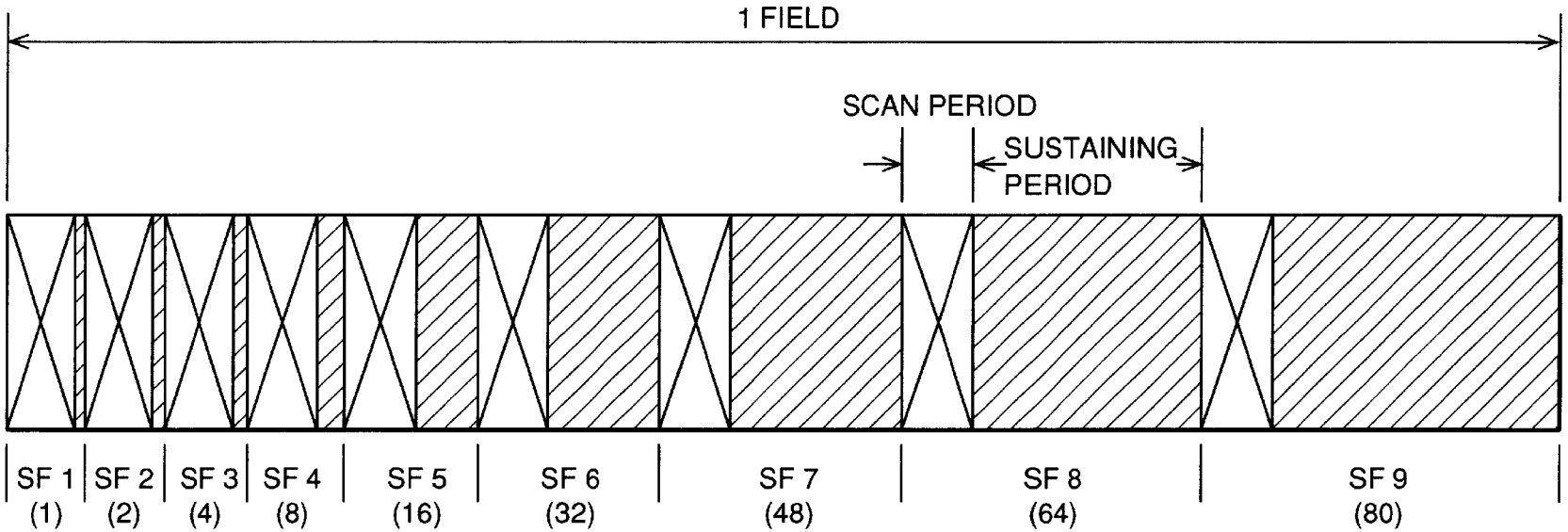
FIG. 2 is a timing chart of sub-fields according to the first embodiment of the present invention.

FIG. 2 is a time chart of the sub-fields shown in FIG. 1. Each sub-field consists of a scan period for which data for determining whether or not the sub-field is to emit light with a weight of its light intensity is written in respective pixels and a sustaining period for emitting light from the panel on the basis of the written data. A time of one field composed of the sub-fields SF1 to SF9 is usually 1/60 seconds, that is, 16.7 milliseconds.

In this example, the sub-fields are arranged first from the lowest sub-field SF1 to the highest sub-field SF9 along a time axis. However, the same effect can be obtained by arranging them in a reverse direction. Further, in the lower four sub-fields SF1 to SF4, the order of the sub-fields SF3 and SF4, SF2 and SF4 or SF2 and SF3 can be reversed. With such reversed arrangement of the specific sub-fields, the time unevenness at the shift-up time of the lower sub-fields is more relaxed and the suppression effect of pseudo contours of moving images becomes large.

FIG. 3 is a table showing combinations of sub-fields according to a second embodiment of the gray scale display method according to the present invention. In this embodiment, the light intensities of the lower four sub-fields SF1 to SF4 are weighted with usual binary numbers as in the case shown in FIG. 1. That is, the light intensity of the lowest, first sub-field SF1 is 1, that of the second sub-field SF2 is 2 which is twice the light intensity of the first sub-field SF1, that of the third sub-field SF3 is 4 which is twice the light intensity of the second sub-field SF2 and that of the fourth sub-field SF4 is 8 which is twice the light intensity of the third sub-field SF3, although the lower sub-fields SF1 to SF4 having light intensities weighted with the binary numbers are omitted from FIG. 3. A difference of FIG. 3 from FIG. 1 is that all of the sub-fields in FIG. 1 except the most significant sub-field SF9 are used to express 176 gray levels from light intensity 0 to light intensity 175. Since the light intensities of the upper sub-fields SF5 to SF8 are weighted such that they are in arithmetic progression having a constant 16 as in the case shown in FIG. 1, a shift-up of one level of a sub-field is a shift to a sub-field adjacent thereto. As a result, the time unevenness at the shift-up time of the lower sub-fields is relaxed and pseudo contours of moving images is substantially suppressed.

FIG. 4 is a table showing combinations of sub-fields based on a third embodiment of the gray scale display method according to the present invention. In this embodiment, in order to relax the unevenness of time at the shift-up of a lower sub-field, the sub-fields SF1, SF2, SF3, SF4 and SF5 are assigned to light intensities 1, 2, 3, 7 and 8, respectively. Therefore, as shown in FIG. 4, the change of light intensity level by one level from the light intensity 15 to the light intensity 16 is realized by merely shifting light emission of the sub-fields SF4 and SF5 to the sub-field SF6 (corresponds to the sub-field SF5 in FIGS. 1 and 3) weighted to light intensity of 16.

FIG. 5 is a table showing combinations of sub-fields based on a fourth embodiment of the gray scale display method according to the present invention. In this embodiment, in order to relax the unevenness of time at the shift-up of a lower sub-field, the sub-fields SF1, SF2, SF3, SF4 and SF5 are assigned to light intensities 1, 2, 3, 7 and 8, respectively. Therefore, as shown in FIG. 5, the change of light intensity level by one level from the light intensity 7 to the light intensity 8 is realized by merely shifting light emission of the sub-field SF4 to the subfield SF5. Further, the change of light intensity by one level from the light intensity 15 to light intensity 16 is realized by merely shifting the light emission of the sub-fields SF1, SF4 and SF5 to the sub-field SF6 (corresponds to the sub-field SF5 in FIGS. 1 and 3) weighted to light intensity of 16. In this manner, it is possible to suppress the contour degradation of moving images by weighting the lower sub-field.

FIGS. 6 and 7 show a table of combinations of sub-fields for expressing 222 gray levels, according to a fifth embodiment of the present invention. In this embodiment, the weighting is performed such that the least significant bit B0 is 1, a first bit B1 is 2 and an i-th bit B(i) is B(i−1) +B(i−2)+1. That is, as shown in FIG. 6, the bits B2, B3, B4, B5, B6, B7 and B8 are weighted by 4, 7, 12, 20, 33, 54 and 88, respectively. With such weighting, a shift-up occurs in the i-th bit B(i) when both (i−2)-th bit B(i−2) and (i−1)-th bit B(i−1) are shifted up from 1 by one level. That is, after the lower 2 bits become 1, the shift-up occurs. In the conventional weighting with binary numbers shown in FIG. 18, when all of (i−1)-th bit to the least significant bit are shifted up from 1 by one gray level, i-th bit becomes 1 and all of (i−1)-th bit to the least significant bit are substantially changed from 1 to 0. In this embodiment, however, only the lower 2 bits at most are changed from 0 to 1 at the shift-up time. Further, comparing with the gay scale expression method shown in FIGS. 1, 3, 4 and 5, the change at the shift-up of the lower 4 bits is also restricted. Therefore, the variations of light emitting period when the change of light intensity at the shift-up time of the respective sub-fields can be substantially reduced and pseudo contours of moving images is substantially suppressed.

FIGS. 9 and 10 show a table of combinations of sub-fields for expressing 71 gray levels, according to a sixth embodiment of the present invention. In this embodiment, the weighting of sub-fields is performed such that the least significant bit B0 is 1, a first bit B1 is 2 and an i-th bit Bi is B(i−1)+B(i−2)−B(i−3)+1. That is, as shown in FIGS. 9 and 10, the bits B2, B3, B4, B5, B6 and B7 are weighted by 4, 6, 9, 12, 16 and 20, respectively. With such weighting, a shift-up occurs in the i-th bit B(i) when both (i −2)-th bit B(i−2) and (i−1)-th bit B(i−1) are shifted up from 1 by one level. Further, upon the shift-up, the i-th bit B(i) is changed from 0 to 1 and, simultaneously, the (i−3)-th bit B(i−3) is also changed from 0 to 1. That is, the shift-up occurs after the lower 2 bits are 1 and the (B(i−3), B(i−2), B(i[|m]-1), B(i)) expressed by (0, 1, 1, 0) are expressed by (1, 0, 0, 1). In the conventional weighting with binary numbers shown in FIG. 18, the i-th bit becomes 1 when all of (i−1)-th bit to the least significant bit are shifted up from light intensity 1 by one gray level and all of (i−1)-th bit to the least significant bit are substantially changed from 1 to 0. In this embodiment, however, only the lower 2 bits at most are changed from 0 to 1 at the shift-up time. Further, since not only the i-th bit but also the (i−3)-th bit are changed to 1 simultaneously, it is possible to disperse the time variation of light intensity. Further, comparing with the gray scale expression method shown in FIGS. 1, 3, 4 and 5, the change at the shift-up of the lower 4 bits is also restricted. Therefore, since the variations of light emitting period at the change of light intensity at the shift-up time of the respective sub-fields can be substantially reduced and dispersed with using this weighting as shown in FIGS. 9 and 10, pseudo contours of moving images is substantially suppressed. by one level. Further, upon the shift-up, the i-th bit Bi is changed from 0 to 1 and, simultaneously, the (i−3)-th bit Bi−3 is also changed from 0 to 1. That is, the shift-up occurs after the lower 2 bits are 1 and the (Bi−3, Bi−2, Bi−1, Bi) expressed by (0, 1, 1, 0) are expressed by (1, 0, 0, 1). In the conventional weighting with binary numbers shown in FIG. 18, the i-th bit becomes 1 when all of (i−1)-th bit to the least significant bit are shifted up from light Ad intensity 1 by one gray level and all of (i−1)-th bit to the least significant bit are substantially changed from 1 to 0. In this embodiment, however, only the lower 2 bits at most are changed from 0 to 1 at the shift-up time. Further, since not only the i-th bit but also the (i−3)-th bit are changed to 1 simultaneously, it is possible to disperse the time variation of light intensity. Further, comparing with the gay scale expression method shown in FIGS. 1, 3, 4 and 5, the change at the shift-up of the lower 4 bits is also restricted. Therefore, since the variations of light emitting period at the change of light intensity at the shift up time of the respective sub-fields can be substantially reduced and dispersed with using this weighting as shown in FIGS. 9 and 10, pseudo contours of moving images is substantially suppressed.

The weighting shown in FIGS. 9 and 10 has redundancy of information. Therefore, it is possible to express one and the same gray level by any of different codes shown in a second or third column shown in FIGS. 9 and 10. For example, the gray level 15 can be expressed by any of three codes (01101000) in the first column, (11000100) in the second column and (00011000) in the third column. it is possible to select any one of these different expressions every pixel, every line or every frame. For example, it is possible to cause odd numbered lines to light by using the codes in the first column and cause even numbered lines to light by using the codes in the second column, or to change the codes every frame. Upon such scheme, the time unevenness at the shift-up time of the lower sub-fields is relaxed and pseudo contours of moving images is substantially suppressed.

FIGS. 11(*a*), 11(*b*), 11(*c*) and 11(*d*) show sub-field arrangements based on a seventh embodiment of the present invention. These sub-fields are featured by that upper sub-fields expressing high light intensity are divided and the divided sub-fields are arranged on both sides of a sub-field expressing the highest gray level or a sub-field expressing a high gray level next to the highest gray level.

In the arrangement shown in FIG. 11(a), a sub-field having light intensity 48 corresponding to the sixth bit (B6) of the sub-field arrangement shown in FIG. 3 is divided into two sub-fields. Similarly, a sub-field having light intensity 32 corresponding to B5 is divided into two sub-fields having light intensity 16, a sub-field having light intensity 16 corresponding to B4 is divided into two sub-fields having light intensity 8 and a sub-field having light intensity 8 corresponding to B3 is divided into two sub-fields having light intensity 4. The sub-fields (SF3, SF11), (SF4, SF10), (SF5, SF9) and (SF6, SF8) obtained by dividing the sub-fields B6, B5, B4 and B3 are arranged on both sides of the sub-field SF7 having light intensity of 64 corresponding to the highest bit B7. By arranging the divided sub-fields symmetrically on a time axis, the contour degradation of moving images caused by lighting and extinguishing the divided sub-fields is cancelled out, so that pseudo contours of moving image is suppressed.

The arrangement shown in FIG. 11(*b*) differs from that shown in FIG. 11(*a*) in which the upper sub-fields are divided into to two sub-fields, respectively, and the divided sub-fields are arranged on both sides, in that a sub-field of the bit 6 (B6) next to the most significant bit B7 is not divided and arranged in a center as the sub-field SF7 having light intensity of 48 and the sub-fields SF6 and SF8 having light intensity of 32 and obtained by dividing the sub-field of the most significant bit B7 are arranged on both sides of the undivided sub-field SF7. According to the arrangement of sub-field shown in FIG. 11(*b*), pseudo contours of moving images caused by the divided sub-fields is cancelled out, so that the image quality is improved, similarly to the case shown in FIG. 11(*a*).

FIGS. 11(*c*) and 11(*d*) show sub-field arrangements in each of which divided sub-fields are arranged around non-divided sub-field, similarly to those shown in FIGS. 11(*a*) and 11(*b*) except that the sub-field SF9 of the bit 8 is removed.

FIGS. 12(*a*), 12(*b*), 12(*c*) and 12(*d*)show sub-field arrangements based on an eighth embodiment of the present invention, in which the weight of the bit number B3 arranged in the 12-th sub-field (SF12) based on the seventh embodiment shown in FIGS. 11(*a*) to 11(*d*) is arranged adjacent to the bit number B2 arranged in the second sub-field SF2. With such arrangements, the variations of light emitting period when the change of light intensity at the shift up from the bit B1 to B2 is reduced compared with FIG. 12, so that the generation of the contour degradation of moving images on a dark screen can be suppressed.

Figure 8:
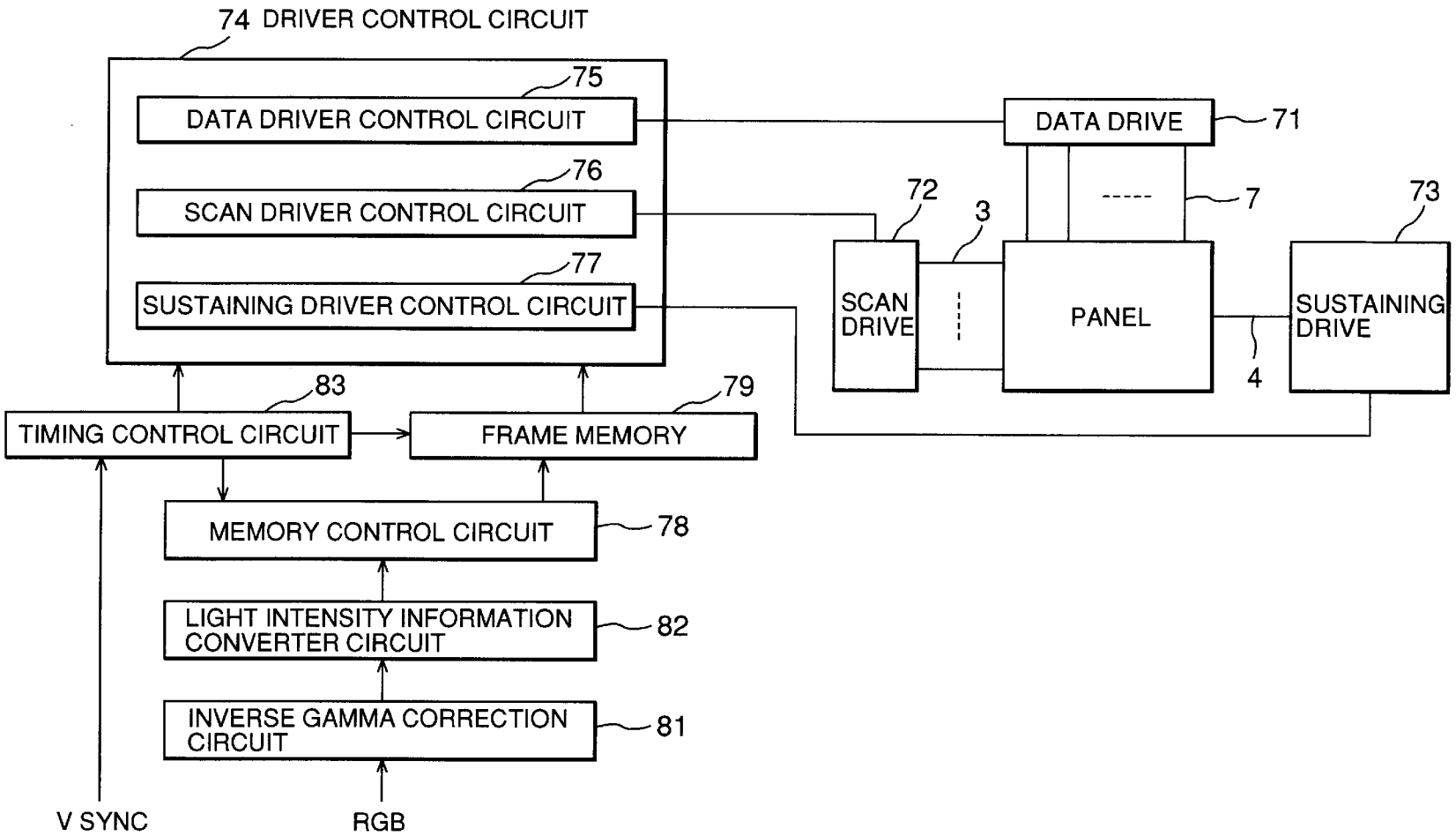
FIG. 8 is a block diagram showing a gray scale display device according to the present invention.

FIG. 8 is a block diagram of an embodiment of a gray scale display device of the plasma display panel (PDP) shown in FIG. 13, according to the present invention. The data electrodes 7 of the PDP (FIG. 13) are connected to a data driver 71, respectively. The data driver 71 supplies data pulses to the data electrodes 7 during the write scan period.

The scan electrodes 3 of the PDP (FIG. 13) are connected to a scan driver 72, respectively. The scan driver 72 supplies scan pulses to the scan electrodes to accumulate, together with the data pulses supplied to the go data electrodes 7, the wall charge necessary for subsequent light emission.

On the other hand, the sustaining electrode 4 of the PDP, which is connected commonly to all of the display lines of the PDP, is connected to a sustaining driver 73 such that the sustaining driver 73 supplies a sustaining pulse to the whole surface of the PDP.

The data driver 71, the scan driver 72 and the sustaining driver 73 are controlled by a driver control circuit 74. The driver control circuit 74 includes a data driver control circuit 75, a scan driver control circuit 76 and a sustaining driver control circuit 77. The data driver 71 is connected to the data driver control circuit 75. The data driver control circuit 75 takes display data signals (R7~0, G7~0 and B7~0) input externally through a memory control circuit 78, etc., in a frame memory 79 and supplies data to be selected from the frame memory to the data electrodes 7.

The scan driver 72 is connected to the scan driver control circuit 76 and, responsive to a vertical sync signal which is a signal for controlling a start of one field or one frame, drives the scan electrodes 3 sequentially and selectively. The drive timing is determined by a timing pulse generated by a timing control circuit 83 which operates in synchronism with the vertical sync signal.

The RGB display data supplied externally is supplied to an inverse gamma correction circuit 81 in which it is corrected such that it matches with the light intensity characteristics of the plasma display panel. In a case of 256 gray levels, the inverse gamma correction circuit 81 is realized by using a Read-Only-Memory of 256 words each being 8 bits. The display data consisting of RGB each of 8 bits converted by the inverse gamma correction circuit 81 is supplied to a light intensity information converter circuit 82. The light intensity information converter circuit 82 responds to the RGB data expressing 256 gray levels each being 8 bits to convert it into a display data at least upper bits of which are weighted in arithmetic progression, for example, the bits shown in FIGS. 1, 3 and 4 and supplies the display data through the memory control circuit 78 to the frame memory 79.

The output of the light intensity information converter circuit 82 can be realized easily by using the Read-Only-Memory (ROM). For example, in the method shown in FIG. 1, the light intensity information converter circuit 82 can be realized by using a ROM of 256 words each being 9 bits or more and, in the example shown in FIG. 3, the converter circuit can be realized by a ROM of 256 words each being 8 bits. Even in a case where lower significant bits are weighted according to the method shown in FIG. 4, it can be realized by a ROM of 256 words each being 9 bits or 10 bits.

Incidentally, when the light intensity information is converted in parallel with respect to the RGB signal corresponding to red, green and blue, the number of ROM's required becomes three times.

Although, in the example shown in FIG. 8, the light intensity information converter circuit 82 is provided after the inverse gamma correction circuit 81, it may be provided after the frame memory 79. In the latter case, there is no need of increasing the number of bits of the frame memory 79.

Further, it is possible to realize both the inverse gamma correction circuit 81 and the light intensity information converter circuit 82 by using a single ROM. In such case, an inverse gamma correction as well as a light intensity information having upper bits weighted in arithmetic progression as shown in FIG. 1 are derived from the single ROM. Thus, it is possible to reduce the number of ROM's to a half.

Although, in the embodiments, the case where the plane discharge type AC plasma display is driven by providing the scanning period separately from the sustaining period, the present invention is effectively utilized similarly in a flat type display device such as AC type plasma display panel of other driving system or having other structures of such as orthogonal 3 electrode type and a DC type plasma display panel, provided that they perform gray scale display according to the sub-field method.

The light intensity of each sub-field is generally determined by the number of the sustaining discharge pulses. However, a relation between light intensity and sustaining discharge pulse number is not linear and there is a tendency that the higher the light intensity due to phenomenon such as light intensity saturation requires the larger the number of sustaining pulses. Further, since the relation between light intensity and sustaining pulse number is different every fluorescent material, the numbers of sustaining pulses corresponding to the same light intensity for red, green and blue are not the same.

When the present invention is applied to the non-interlace system, it is enough to replace the sub-field by sub-frame. Further, although the weighting in arithmetic progression has been described, substantially the same effect can be obtained when a light intensity of a sub-field is within a range from a value smaller than two times a light intensity of a lower sub-field adjacent to the sub-field to a value exceeding the light intensity of the lower sub-field. Therefore, the arithmetic progression does not limit the scope of the present invention.

As described hereinbefore, according to the present invention, the change of light intensity by shift-up of 1 gray level in displaying gray scale by combinations of sub-fields merely causes a shift of light emitting period to an adjacent sub-field. Therefore, the time unevenness can be substantially reduced and the contour degradation of moving images which occurs in displaying a moving image having gray scale changing smoothly and is the problem of the conventional techniques can be substantially suppressed, resulting in a high image quality gray scale display method and a gray scale display device.

Further, comparing with the conventional gray scale display method using sub-fields whose highest light intensity is weighted with binary number, the sub-fields according to the present method can be made smaller, so that jumping of gray level due to light intensity saturation is reduced and a display of smooth image can be done.

What is claimed is:

1. A gray scale display device for displaying gray levels by combining plurality of sub-fields obtained by dividing one field period, comprising:

a light intensity information converter circuit, responsive to a light intensity of said combined sub-fields, for outputting light intensity information, wherein said sub-fields include at least one set of 3 sub-fields having a first sub-field, a second sub-field adjacent to said first sub-field having a light intensity smaller than two times a light intensity of said first sub-field and larger than said light intensity of said first sub-field, and a third sub-field adjacent to said second sub-field having a light intensity smaller than two times said light intensity of said second sub-field and larger than said light intensity of said second sub-field, wherein a difference between said light intensity of said first sub-field and said light intensity of said second sub-field is substantially equal to a difference between said light intensity of said second sub-field and said light intensity of said third sub-field.

2. A gray scale display device for displaying gray levels by combining plurality of sub-fields obtained by dividing one field period, comprising:

a light intensity information converter circuit, responsive to light intensity of said combined sub-fields, for outputting light intensity information, wherein said sub-fields include at least one set of 3 sub-fields having a (i)-th sub-field, (i−1)-th sub-field adjacent to said (i)-th sub-field, a (i−2)-th sub-field adjacent to said (i−1)-th sub-field, wherein weighting value of light intensity of said (i)-th sub-field is larger than weighting value of light intensity of said (i−1)-th sub-field, weighting value of light intensity of said (i−1)-th sub-field is larger than weighting value of light intensity of said (i−2)-th sub-field, said weighting value of light intensity of said (i)-th sub-field is equal to a sum of said weighting value of light intensity of said (i−1)-th sub-field and weighting value of light intensity of said (i−2)-th sub-field and 1.

3. A gray scale display device for displaying gray levels by combining plurality of sub-fields obtained by dividing one field period, comprising:

a light intensity information converter circuit, responsive to light intensity of said combined sub-fields, for outputting light intensity information, wherein said sub-fields include at least one set of 4 sub-fields having a (i)-th sub-field, a (i−1)-th sub-field adjacent to said (i)-th sub-field, a (i−2)-th sub-field adjacent to said (i−1)-th subfield, a (i−3)-th sub-field adjacent to said (i−2)-th sub-field, wherein weighting value of light intensity of said (i)-th sub-field is larger than weighting value of light intensity of said (i−1)-th sub-field, weighting value of light intensity of said (i−1)-th sub-field is larger than weighting value of light intensity of said (i−2)-th sub-field, weighting value of light intensity of said (i−2)-th sub-field is larger than weighting value of light intensity of said (i−3)-th sub-field, a sum of said weighting value of light intensity of said (i)-th sub-field and said weighting value of light intensity of said (i−3)-th sub-field is equal to a sum of said weighting value of light intensity of said (i−1)-th sub-field and weighting value of light intensity of said (i−2)-th sub field and 1.

4. A gray scale display method, comprising:

combining plurality of sub-fields obtained by dividing one field period; and displaying a gray level according to the combined sub-fields, wherein said sub-fields include at least one set of 3 sub-fields having a first sub-field, a second sub-field adjacent to said first sub-field having a light intensity smaller than two times a light intensity of said first sub-field and larger than said-light intensity of said first sub-field, and a third sub-field adjacent to said second sub-field having a light intensity smaller than two times said light intensity of said second subfield and larger than said light intensity of said second sub-field, wherein a difference between said light intensity of said first sub-field and said light intensity of said second sub-field is substantially equal to a difference between said light intensity of said second sub-field and said light intensity of said third sub-field.

5. A gray scale display method, comprising:

combining plurality of sub-fields obtained by dividing one field periods; and displaying a gray level according to the combined sub-fields, wherein said sub-fields include at least one set of 3 sub-fields having a (i)-th sub-field, a (i−1)-th sub-field adjacent to said (i)-th sub-field, a (i−2)-th sub-field adjacent to said (i−1)-th sub-field, wherein weighting value of light intensity of said (i)-th sub-field is larger than weighting value of light intensity of said (i−1)-th sub-field, wherein weighting value of light intensity of said (i−1)-th sub-field is larger than weighting value of light intensity of said (i−2)-th sub-field, said weighting value of light intensity of said (i)-th sub-field is equal to a sum of said weighting value of light intensity of said (i−1)-th sub-field and weighting value of light intensity of said (i−2)-th sub-field and 1.

6. A gray scale display method, comprising:

combining plurality of sub-fields obtained by dividing one field period; and displaying a gray level according to the combined sub-fields, wherein said sub-fields include at least one set of 4 sub-fields having a (i)-th sub-field, a (i−1)-th sub-field adjacent to said (i)-th sub-field, a (i−2)-th sub-field adjacent to said (i−1)-th sub-field, a (i−3)-th sub-field adjacent to said (i−2)-th sub-field, wherein weighting value of light intensity of said (i)-th sub-field is larger than weighting value of light intensity of said (i−1)-th sub-field, wherein weighting value of light intensity of said (i−1)-th sub-field is larger than weighting value of light intensity of said (i−2)-th sub-field, wherein weighting value of light intensity of said (i−2)-th sub-field is larger than weighting value of light intensity of said (i−3)-th sub-field, a sum of said weighting value of light intensity of said (i)-th sub-field and said weighting value of light intensity of said (i−3)-th sub-field is equal to a sum of said weighting value of light intensity of said (i−1)-th sub-field and weighting value of light intensity of said (i−2)-th sub-field and 1.

* * * * *